US005723862A

United States Patent [19]

Forman

[11] Patent Number: 5,723,862

[45] Date of Patent: Mar. 3, 1998

[54] MASS SPECTROMETER UTILIZING HIGH ENERGY PRODUCT DENSITY PERMANENT MAGNETS

[76] Inventor: Leon Forman, 52 Pardam Knoll Rd., Miller Place, N.Y. 11764

[21] Appl. No.: 610,370

[22] Filed: Mar. 4, 1996

[51] Int. Cl.[6] ..... H01J 49/26

[52] U.S. Cl. ..... 250/294; 250/296; 250/298

[58] Field of Search ..... 250/294, 295, 250/296, 297, 298, 299, 281, 282

[56] References Cited

U.S. PATENT DOCUMENTS

| | | | |
|---|---|---|---|
| 3,031,596 | 4/1962 | Leboutet et al. | 250/298 |
| 3,686,500 | 8/1972 | Kleinwächter | 250/298 |
| 3,705,320 | 12/1972 | Freeman | 250/298 |
| 3,761,707 | 9/1973 | Liebl | 250/294 |
| 4,054,796 | 10/1977 | Maito | 250/294 |
| 5,153,433 | 10/1992 | Andresen et al. | 250/296 |
| 5,313,061 | 5/1994 | Drew et al. | 250/298 |
| 5,317,151 | 5/1994 | Sinha et al. | 250/298 |

*Primary Examiner*—Michael J. Tokar
*Assistant Examiner*—Kiet T. Nguyen
*Attorney, Agent, or Firm*—Richard L. Miller, P.E.

[57] ABSTRACT

A small radii mass spectrometer that utilizes high energy density permanent magnets of greater than 10E7 GOe for focusing an ion trajectory. The ion optical path employs focusing of the parallel component of the beam emitted by the source such that the momentum selected beam is focused in 90° geometry at or near the exit pole face. The width of the beam at the focal point is independent of the size of the beam exiting the ion source in first order but has a second order aberration term dependent on the source width and radius of curvature. The dominant terms in determining the collected beam width are the angular divergence of the source (which can be reduced by defining slit) and the energy spread of the ion beam. A second magnet may be used in tandem with the first magnet to cancel the second order aberration term and reduces the background created by ions scattering with residual gas molecules in the vacuum chamber. A slit between the tandem magnets is used in concert with a final defining slit to increase the resolution. Standard source technology including sample inlet through gas chromatography may be used for the ion source and the separated ion beam output may be used for mass spectrometry, ion implantation, leak detection, nuclear reaction phenomenology, and any other applications requiring a separated mass beam.

28 Claims, 6 Drawing Sheets

FIG. 1
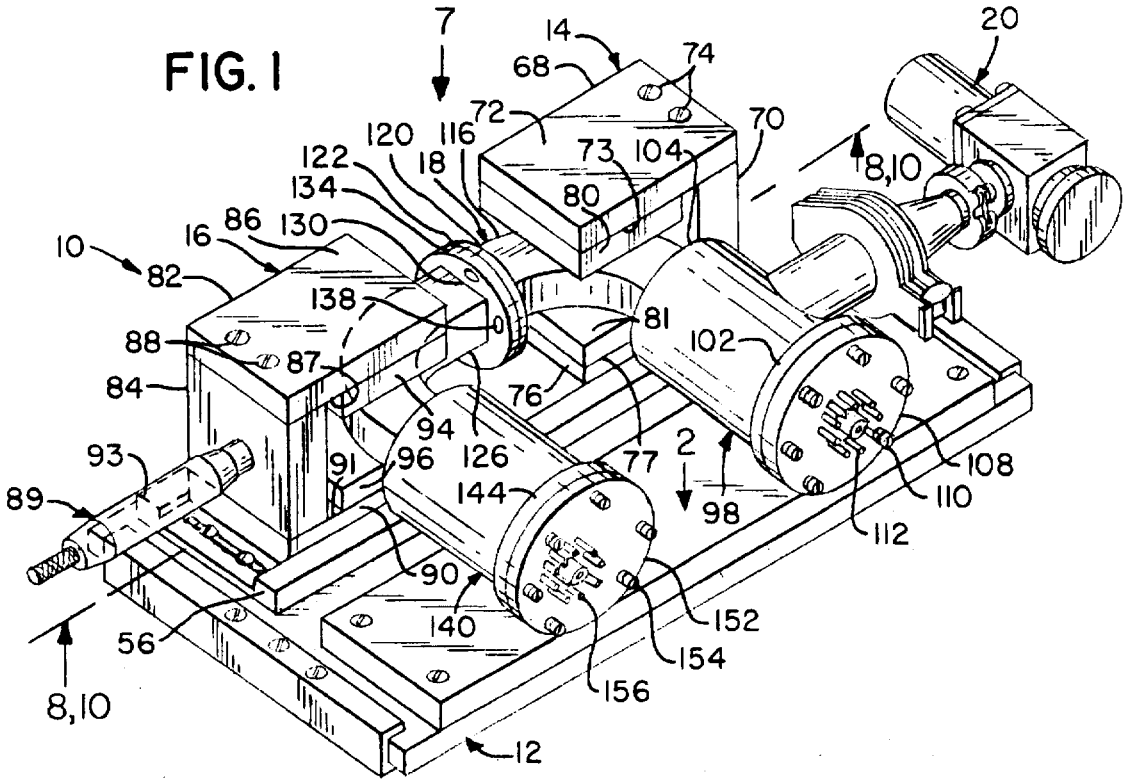
FIG. 7
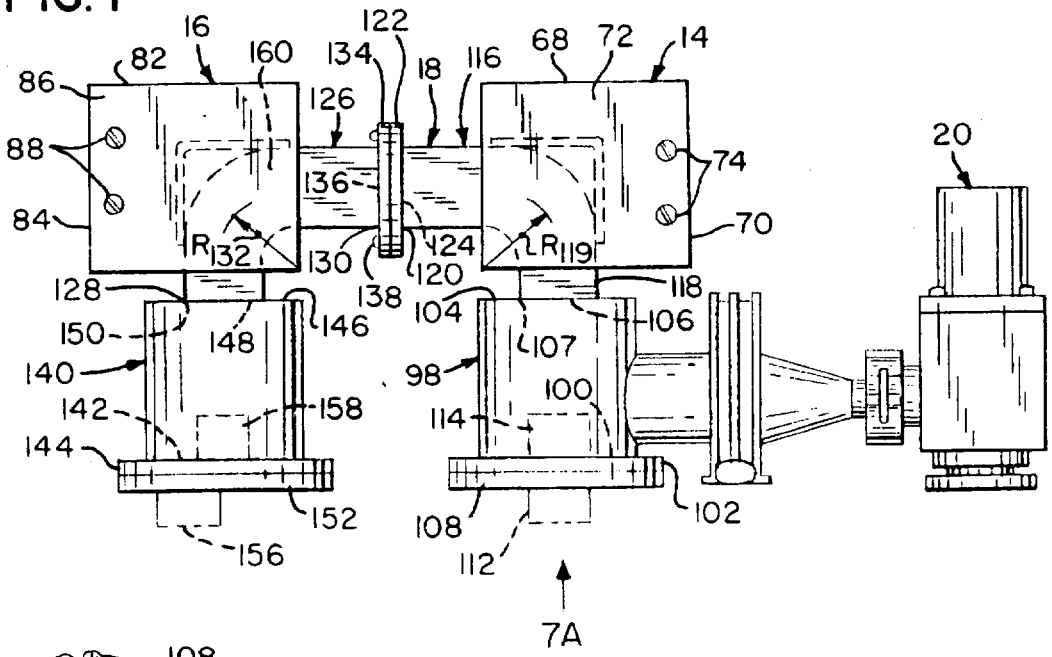
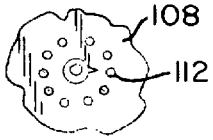
FIG. 7A

FIG.2
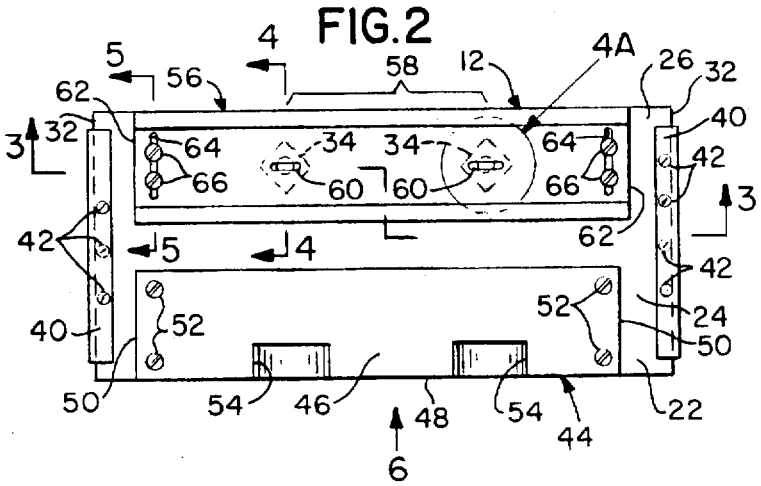
FIG.4
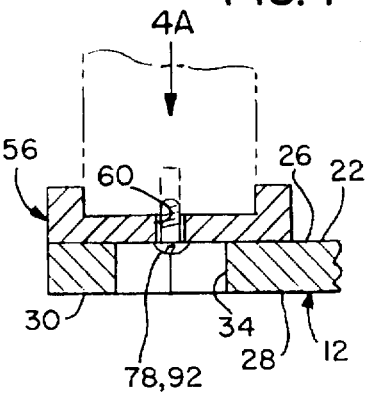
FIG.3
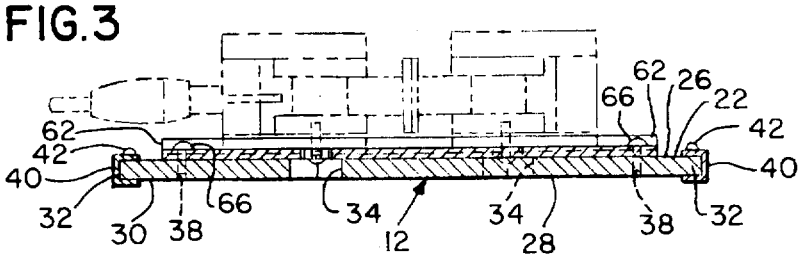
FIG.5
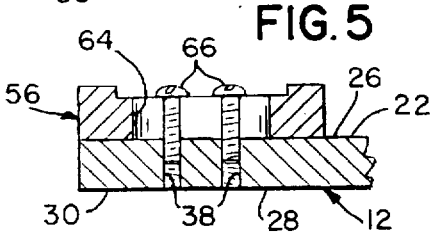
FIG.6
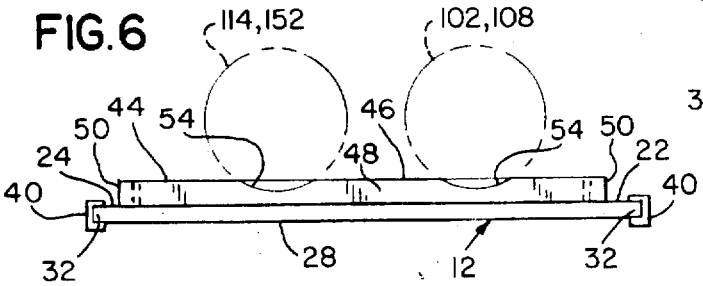
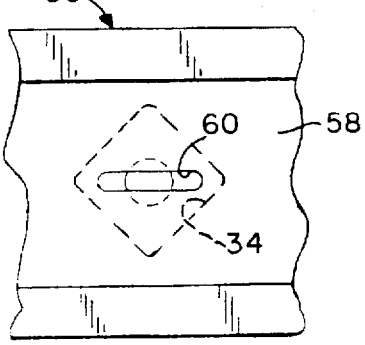
FIG. 4A

MASS SPECTROMETER UTILIZING HIGH ENERGY PRODUCT DENSITY PERMANENT MAGNETS

BACKGROUND OF THE INVENTION

The present invention relates to a mass spectrometer. More particularly, the present invention relates to a small magnetic sector mass spectrometer that uses high energy product density permanent magnets.

Modern magnetic sector mass spectrometers are generally attributed to the principles demonstrated by Aston and Dempster. Aston and Dempster showed that an ion beam could be separated into components by their mass using the momentum selection of a magnetic field and that the beam could be focused for angular divergence caused by the angular spread of ions leaving the source.

Further refinements using consecutive electrostatic lens were demonstrated most notably by Mattauch and Hertzog who showed that a beam could be focused for both angular and energy divergence for all masses along a focal plane. An example of a type of miniature high density permanent magnet design utilizing this geometry is taught by U.S. Pat. No. 5,317,151 to Sinha et al.

U.S. Pat. No. 5,317,151 to Sinha et al. teaches a magnetic sector for a non-scanning mass spectrometer that includes a high permeability yoke with opposing faces to which are attached high energy product magnets and shaped pole pieces separated by a gap, so that a high magnetic flux exists in the gap. The high magnetic flux in the gap enables very small surface areas of the pole piece faces forming the gap.

These historic types of magnet sector designs have been used in mass spectrometric applications for many years, however, the fundamental limitation in achieved resolution is the width of the beam leaving the ion source. In principle, perfect focusing would result in a beam whose size is equal to the magnified source width as measured at the collector and the resolution (measure of ability to separate masses) is related to the radius of curvature of the sector divided by the collected beam size.

Laboratory instruments of nominal radii, such as 30 cm, can achieve a resolution of 1,000 or more using a small (less than 1 mm) source exit slit. When the radius of curvature of the instrument approaches 1 cm in these designs, however, the ion source exit slit must be made very narrow to achieve equivalent resolution, hence there is a large loss of sensitivity. Moreover, mechanical alignments with small slits can be difficult and sensitive to vibration especially in field applications. An alternative approach in a small radius sector geometry is to focus the source exit beam width and allow the angular dispersion to be the limiting factor in resolution.

There is a growing need for small, portable and inexpensive mass spectrometers for measurements in field such as air quality analysis, drug detection, and chemical analysis. There is a continuing need for a separated mass beam for ion implantation, sputtering, nuclear reaction studies, and leak detection. The resolution requirement for many of these applications is less than 100. A portable double focusing instrument with a small magnetic sector radius is taught by U.S. Pat. No. 5,153,433 to Andresen et al.

U.S. Pat. No. 5,153,433 to Andresen et al. teaches a portable mass spectrometer that includes one or more electrostatic focusing sectors and a magnetic focusing sector. The one or more electrostatic focusing sectors and the magnetic focusing sector is positioned inside a vacuum chamber and are adjustable via adjustment means accessible from outside the vacuum chamber.

As high energy product density (greater than 10E7 GOe) magnetic material has become available, mass spectrometry can be achieved in a few cm radius of curvature permanent magnet instrument and can be operated at low power. Such instruments are relatively small, thus require a low volume system and can be operated by vacuum systems, such as getter ion pumps, that can be driven by a few watts.

No power is need for permanent magnet sector mass separation. For most applications, the dominant power requirement would be for the ion source which would typically be tens of watts.

It is apparent that numerous innovations for mass spectrometers have been provided in the prior art that are adapted to be used. Furthermore, even though these innovations may be suitable for the specific individual purposes to which they address, they are limited for the purposes of the present invention as heretofore described.

SUMMARY OF THE INVENTION

This invention relates to sector mass spectrometers having high energy product density magnets, and therefore, a small radius of curvature. Momentum selection of an ion beam is accomplished in a 90° sector magnet where focusing of the parallel component of the beam occurs at or about the exit point of the magnetic pole pieces. Resolution of the system becomes relatively independent of the ion exit slit of the source, but is limited by the angular divergence of the source. A second magnet may be used in tandem with the first magnet to reduce scattered background and increase resolution. When two magnets are used in tandem, it is possible to operate the mass spectrometer in either the source focus mode described above or the traditional consecutive angular focus mode. The source focus mode outperforms the traditional angular focus mode in substantially every comparison when the radius of curvature is less that 4 cm.

ACCORDINGLY, AN OBJECT of the present invention is to provide a mass spectrometer that avoids the disadvantages of the prior art as applied to very small instruments.

ANOTHER OBJECT of the present invention is to provide a mass spectrometer that is simple and inexpensive to manufacture.

STILL ANOTHER OBJECT of the present invention is to provide a mass spectrometer that is simple to use.

YET ANOTHER OBJECT of the present invention is to provide a mass spectrometer that applies high energy density permanent magnets for small radii mass spectrometers in the ion focusing trajectory that achieves useful resolution (greater than 30 for electron bombardment source) at high source transmission.

STILL YET ANOTHER OBJECT of the present invention is to provide a mass spectrometer wherein the ion optical path employs focusing of the parallel component of the beam emitted by the source such that the momentum selected beam is focused in 90° geometry at or near the exit pole face.

YET STILL ANOTHER OBJECT of the present invention is to provide a mass spectrometer wherein the width of the beam at the focal point can be operated in a mode that is independent of the size of the beam exiting the ion source in first order but has an aberration term dependent on the source width and the radius of curvature of the magnet.

STILL YET ANOTHER OBJECT of the present invention is to provide a mass spectrometer that achieves mass spectrometry in a few cm radius of curvature permanent magnet instrument and can be operated at low power.

YET STILL ANOTHER OBJECT of the present invention is to provide a mass spectrometer that is relatively small.

STILL YET ANOTHER OBJECT of the present invention is to provide a mass spectrometer that requires a low volume system and can be operated by vacuum systems, such as getter ion pumps, that can be driven by a few watts.

BRIEFLY STATED, YET STILL ANOTHER OBJECT of the present invention is to provide a mass spectrometer that includes a base, first magnetic field generating apparatus, a smoothly bent magnetic deflection flight tube assembly, introducing apparatus, ionizing apparatus, and collecting apparatus.

STILL YET ANOTHER OBJECT of the present invention is to provide a mass spectrometer wherein the first magnetic field generating apparatus is mounted to the base and generates a 90° magnetic field with a radius of curvature and having an entrance and an exit.

YET STILL ANOTHER OBJECT of the present invention is to provide a mass spectrometer wherein the smoothly bent magnetic deflection flight tube assembly passes through the first 90° magnetic field and contains a vacuum chamber of less than 3×10E-5 Torr.

STILL YET ANOTHER OBJECT of the present invention is to provide a mass spectrometer wherein the introducing apparatus is disposed in the vacuum chamber of the smoothly bent magnetic deflection flight tube assembly and introduces a material to be analyzed.

YET STILL ANOTHER OBJECT of the present invention is to provide a mass spectrometer wherein the ionizing apparatus is disposed in the vacuum chamber of the smoothly bent magnetic deflection flight tube assembly and ionizes the material to be analyzed.

STILL YET ANOTHER OBJECT of the present invention is to provide a mass spectrometer wherein the ionized material to be analyzed has an ion trajectory contained in the vacuum chamber of the smoothly bent magnetic deflection flight tube assembly.

YET STILL ANOTHER OBJECT of the present invention is to provide a mass spectrometer wherein the ion trajectory of the ionized material to be analyzed has a parallel component that is focused at a point where the trajectory of the ionized material to be analyzed generally exits the first 90° magnetic field generating apparatus.

STILL YET ANOTHER OBJECT of the present invention is to provide a mass spectrometer wherein the collecting apparatus is disposed in the vacuum chamber of the smoothly bent magnetic deflection flight tube assembly and collects and/or measures electrically the ionized material to be analyzed.

YET STILL ANOTHER OBJECT of the present invention is to provide a mass spectrometer wherein the first magnetic field generating apparatus is mounted to the base selected from the group consisting of fixedly and slidably in both lateral and longitudinal directions, so that the first magnetic field generating apparatus has a high intensity position where the first magnetic field generating apparatus is in proximity to the vacuum chamber of the smoothly bent magnetic deflection flight tube assembly allowing for a higher mass spectra to be scanned and a low intensity position where the first magnetic field generating apparatus is external to the vacuum chamber of the smoothly bent magnetic deflection flight tube assembly allowing for a lower mass spectra to be scanned.

STILL YET ANOTHER OBJECT of the present invention is to provide a mass spectrometer wherein the first magnetic field generating apparatus includes a substantially C-shaped soft iron and highly permeable yoke that has an upper horizontal part with an inner surface and a lower horizontal part with an inner surface that is displaced a distance below, and parallel to, the upper horizontal part of the substantially C-shaped soft iron and highly permeable yoke of the first magnetic field generating apparatus.

YET STILL ANOTHER OBJECT of the present invention is to provide a mass spectrometer wherein the first magnetic field generating apparatus further includes an upper high energy product density magnetic 90° pole piece that is square, circular, or sections thereof and is of a magnetic material having a density product greater than 10E7 GOe and is disposed on the inner surface of the upper horizontal part of the substantially C-shaped soft iron and highly permeable yoke of the first magnetic field generating apparatus.

STILL YET ANOTHER OBJECT of the present invention is to provide a mass spectrometer wherein the upper high energy product density magnetic 90° pole piece can be square, circular, or appropriate sections of these shapes and of a thickness to achieve the desired magnetic field and which is affixed to the inner surface of the upper horizontal part of the substantially C-shaped soft iron and highly permeable yoke of the first magnetic field generating apparatus preferably by epoxy or screws.

YET STILL ANOTHER OBJECT of the present invention is to provide a mass spectrometer wherein the first magnetic field generating apparatus further includes a lower high energy product density magnetic 90° pole piece that is disposed on the inner surface of the lower horizontal part of the substantially C-shaped soft iron and highly permeable yoke of the first magnetic field generating apparatus and displaced a distance below, and parallel to, the upper high energy product density magnetic 90° pole piece of the first magnetic field generating apparatus.

STILL YET ANOTHER OBJECT of the present invention is to provide a mass spectrometer wherein the lower high energy product density magnetic 90° pole piece of the first magnetic field generating apparatus has a thickness required to achieve the desired magnetic field and is affixed to the inner surface of the upper horizontal part of the substantially C-shaped soft iron and highly permeable yoke of the first magnetic field generating apparatus preferably by ant suitable material such as epoxy or screws.

YET STILL ANOTHER OBJECT of the present invention is to provide a mass spectrometer wherein the smoothly bent magnetic deflection flight tube assembly passes freely between the upper high energy product density magnetic 90° pole piece of the first magnetic field generating apparatus and the lower high energy product density magnetic 90° pole piece of the first field magnetic field generating apparatus.

STILL YET ANOTHER OBJECT of the present invention is to provide a mass spectrometer wherein the smoothly bent magnetic deflection flight tube assembly includes a first chamber such as constructed as a hollow cylindrically-shaped canister that has an open distal port end with a vacuum flange that extends outwardly from, and surrounds, the open distal port end of the first chamber of the smoothly bent magnetic deflection flight tube assembly, an interior space, and a substantially closed proximal end with a centrally disposed throughbore that has a perimeter.

YET STILL ANOTHER OBJECT of the present invention is to provide a mass spectrometer wherein the smoothly bent magnetic deflection flight tube assembly further includes a removably mounted vacuum sealed section that is removably mounted to the first chamber of the smoothly bent magnetic deflection flight tube assembly and selectively opens and closes the open distal port end of the first chamber of the smoothly bent magnetic deflection flight tube assembly, so that components contained in the first chamber of the smoothly bent magnetic deflection flight tube assembly can be readily accessed.

STILL YET ANOTHER OBJECT of the present invention is to provide a mass spectrometer wherein the removably mounted vacuum sealed section of the first chamber of the smoothly bent magnetic deflection flight tube assembly has a plurality of outwardly extending, isolated, and vacuum sealed electrodes that extend outwardly therefrom.

YET STILL ANOTHER OBJECT of the present invention is to provide a mass spectrometer wherein the ionizing apparatus includes an ion source that is contained in the first chamber of the smoothly bent magnetic deflection flight tube assembly and is selected from the group consisting of positive ion, negative ion, and the introducing apparatus.

STILL YET ANOTHER OBJECT of the present invention is to provide a mass spectrometer wherein the ion source of the first chamber of the smoothly bent magnetic deflection flight tube assembly can be a Nier-type electron bombardment source with an accelerating voltage of 70 to 1000 volts, for a mass scan of 14–200 AMU with a 6 kilogauss magnetic field and a 3.2 cm radius of curvature.

YET STILL ANOTHER OBJECT of the present invention is to provide a mass spectrometer wherein the ion source of the first chamber of the smoothly bent magnetic deflection flight tube assembly is in electrical communication with the plurality of outwardly extending, isolated, and vacuum sealed electrodes of the removably mounted vacuum sealed section of the first chamber of the smoothly bent magnetic deflection flight tube assembly which in turn are in electrical communication with different potentials to power the different components of the ion source of the first chamber of the smoothly bent magnetic deflection flight tube assembly.

STILL YET ANOTHER OBJECT of the present invention is to provide a mass spectrometer wherein the smoothly bent magnetic deflection flight tube assembly further includes a smoothly bent magnetic deflection flight tube with an interior space, an open inlet end that extends outwardly from the throughbore perimeter of the centrally disposed throughbore of the substantially closed proximal end of the first chamber of the smoothly bent magnetic deflection flight tube assembly with the interior space of the first chamber of the smoothly bent magnetic deflection flight tube assembly being in communication with the interior space of the smoothly bent magnetic deflection flight tube of the smoothly bent magnetic deflection flight tube assembly, an open outlet end, and a central radius of curvature.

YET STILL ANOTHER OBJECT of the present invention is to provide a mass spectrometer wherein the central radius of curvature of the smoothly bent magnetic deflection flight tube of the smoothly bent magnetic deflection flight tube assembly is 3.2 cm.

STILL YET ANOTHER OBJECT of the present invention is to provide a mass spectrometer wherein the smoothly bent magnetic deflection flight tube assembly further includes a second chamber which may consist of hollow cylindrically-shaped canister that has an interior space, an open distal port end with a flange that extends outwardly from, and surrounds, the open distal port end of the second chamber, and a substantially closed proximal end with a centrally disposed throughbore that has a throughbore perimeter from which the outlet end of the smoothly bent magnetic deflection flight tube of the smoothly bent magnetic deflection flight tube assembly extends with the interior space of the second chamber of the smoothly bent magnetic deflection flight tube assembly being in communication with the interior space of the smoothly bent magnetic deflection flight tube of the smoothly bent magnetic deflection flight tube assembly.

YET STILL ANOTHER OBJECT of the present invention is to provide a mass spectrometer wherein the smoothly bent magnetic deflection flight tube assembly further includes a removably mounted vacuum sealed section that is removably mounted to the second chamber of the smoothly bent magnetic deflection flight tube assembly and selectively opens and closes the open distal port end of the second chamber of the smoothly bent magnetic deflection flight tube assembly, so that components contained in the second chamber of the smoothly bent magnetic deflection flight tube assembly can be readily accessed.

STILL YET ANOTHER OBJECT of the present invention is to provide a mass spectrometer wherein the removably mounted vacuum sealed section of the second chamber of the smoothly bent magnetic deflection flight tube assembly has a plurality of outwardly extending, isolated, and vacuum sealed electrodes that extend outwardly therefrom.

YET STILL ANOTHER OBJECT of the present invention is to provide a mass spectrometer wherein the collecting apparatus is contained in the second chamber of the smoothly bent magnetic deflection flight tube assembly.

STILL YET ANOTHER OBJECT of the present invention is to provide a mass spectrometer wherein the collecting apparatus of the second chamber of the smoothly bent magnetic deflection flight tube assembly includes an ion detector for detecting and measuring an ion current from 10E-5 to 10E-19 amperes and is selected from the group consisting of a Faraday cup, and an electron multiplier.

YET STILL ANOTHER OBJECT of the present invention is to provide a mass spectrometer wherein the ion detector of the second chamber of the smoothly bent magnetic deflection flight tube assembly is in electrical communication with the plurality of outwardly extending, isolated, and vacuum sealed electrodes of the removably mounted vacuum sealed section of the second chamber of the smoothly bent magnetic deflection flight tube assembly which in turn are in electrical communication with an output device.

STILL YET ANOTHER OBJECT of the present invention is to provide a mass spectrometer wherein the output device is an electrometer.

YET STILL ANOTHER OBJECT of the present invention is to provide a mass spectrometer wherein the vacuum chamber of the smoothly bent magnetic deflection flight tube assembly is continuous and consists of the interior space of the first chamber of the smoothly bent magnetic deflection flight tube assembly, the interior space of the smoothly bent magnetic deflection flight tube of the smoothly bent magnetic deflection flight tube assembly, and the interior space of the second chamber of the smoothly bent magnetic deflection flight tube assembly.

STILL YET ANOTHER OBJECT of the present invention is to provide a mass spectrometer wherein the continuous vacuum chamber of the smoothly bent magnetic deflection guide flight tube assembly is less than 3×10E-5 Torr.

YET STILL ANOTHER OBJECT of the present invention is to provide a mass spectrometer wherein the first chamber of the smoothly bent magnetic deflection flight tube assembly further contains an ion source exit slit for defining the ion trajectory of the ionized material to be analyzed leaving the ion source of the first chamber of the smoothly bent magnetic deflection flight tube assembly, and a first ion trajectory defining slit located between the ion exit slit and the entrance face for further defining the ion trajectory of the ionized material to be analyzed leaving the ion source exit slit of the first chamber of the smoothly bent magnetic deflection flight tube assembly.

STILL YET ANOTHER OBJECT of the present invention is to provide a mass spectrometer wherein the smoothly bent magnetic deflection flight tube assembly further contains a second ion trajectory defining slit for further defining the ion trajectory of the ionized material to be analyzed leaving the first magnetic field generating apparatus.

YET STILL ANOTHER OBJECT of the present invention is to provide a mass spectrometer wherein the smoothly bent magnetic deflection flight tube is 90° arc-shaped with the first chamber of the smoothly bent magnetic deflection flight tube assembly being perpendicular to the second chamber of the smoothly bent magnetic deflection flight tube assembly, so that the ionized material to be analyzed that enters the open inlet end of the 90° arc-shaped magnetic deflection flight tube of the smoothly bent magnetic deflection flight tube assembly will exit the open outlet end of the 90° arc-shaped magnetic deflection flight tube of the smoothly bent magnetic deflection flight tube assembly in a direction 90° from its entry.

STILL YET ANOTHER OBJECT of the present invention is to provide a mass spectrometer wherein the second ion trajectory defining slit of the smoothly bent magnetic deflection flight tube assembly is a collecting slit located at or near the exit pole face contained in the second chamber of the smoothly bent magnetic deflection flight tube assembly.

YET STILL ANOTHER OBJECT of the present invention is to provide a mass spectrometer wherein the collecting slit of the second chamber of the smoothly bent magnetic deflection flight tube assembly can be incorporated with the ion detector of the second chamber of the smoothly bent magnetic deflection flight tube assembly.

STILL YET ANOTHER OBJECT of the present invention is to provide a mass spectrometer using two magnets in tandem wherein the smoothly bent magnetic deflection flight tube is consecutive 90° arc-shaped with the first chamber of the smoothly bent magnetic deflection flight tube assembly being parallel to the second chamber of the smoothly bent magnetic deflection flight tube assembly, so that the ionized material to be analyzed that enters the open inlet end of the consecutive 90° arc-shaped magnetic deflection flight tube of the smoothly bent magnetic deflection flight tube assembly will exit the open outlet end of the consecutive 90° arc-shaped magnetic deflection flight tube of the smoothly bent magnetic deflection flight tube assembly in a direction 180° from its entry.

YET STILL ANOTHER OBJECT of the present invention is to provide a mass spectrometer wherein the consecutive 90° arc-shaped magnetic deflection flight tube of the smoothly bent magnetic deflection flight tube assembly consists of a first 90° arc-shaped portion with a central radius of curvature and a second 90° arc-shaped portion displaced a distance from, and contingent with, the first 90° arc-shaped portion of the consecutive 90° arc-shaped magnetic deflection flight tube of the smoothly bent magnetic deflection flight tube assembly with a central radius of curvature equal to the central radius of curvature of the first 90° portion of the consecutive 90° arc-shaped magnetic deflection flight tube of the smoothly bent magnetic deflection flight tube assembly.

STILL YET ANOTHER OBJECT of the present invention is to provide a mass spectrometer that further includes a second magnetic field generating apparatus identical in configuration to the first magnetic field generating apparatus and providing double momentum selection that allows for the reduction of the effect of scattered ions, so that adjacent masses can be more readily identified in a quantifiable way.

YET STILL ANOTHER OBJECT of the present invention is to provide a mass spectrometer wherein the second magnetic field generating apparatus is slidably mounted to the base portion in both lateral and longitudinal directions and spaced a distance from the first magnetic field generating apparatus in tandem relationship.

STILL YET ANOTHER OBJECT of the present invention is to provide a mass spectrometer wherein each of the 90° magnetic field of the first magnetic field generating apparatus and the 90° magnetic field of the second magnetic field generating apparatus can be 6000 Gauss.

YET STILL ANOTHER OBJECT of the present invention is to provide a mass spectrometer wherein the consecutive 90° arc-shaped magnetic deflection flight tube of the smoothly bent magnetic deflection flight tube assembly passes between the upper high energy product density magnetic 90° sector with linear or circular pole tips of the first magnetic field generating apparatus and the lower high energy product density magnetic 90° sector with linear or circular pole tips of the first magnetic field generating apparatus and between the upper high energy product density magnetic 90° sector with linear or circular pole tips of the second magnetic field generating apparatus and the lower high energy product density magnetic 90° sector with linear or circular pole tips of the second magnetic field generating apparatus.

STILL YET ANOTHER OBJECT of the present invention is to provide a mass spectrometer wherein the second ion trajectory defining slit of the smoothly bent magnetic deflection flight tube assembly is contained in the consecutive 90° arc-shaped magnetic deflection flight tube midway between the first magnetic field generating apparatus and the second magnetic field generating apparatus, although the second ion trajectory defining slit of the smoothly bent magnetic deflection flight tube assembly may alternatively be provided at the exit of the first magnetic field generating apparatus.

YET STILL ANOTHER OBJECT of the present invention is to provide a mass spectrometer wherein the smoothly bent magnetic deflection flight tube assembly further includes a collecting slit contained in the second chamber of the smoothly bent magnetic deflection flight tube assembly.

STILL YET ANOTHER OBJECT of the present invention is to provide a mass spectrometer wherein when the first magnetic field generating apparatus and the second magnetic field generating apparatus are in the low intensity position, a line connecting the ion source exit slit of the first chamber of the smoothly bent magnetic deflection flight tube assembly to the second ion trajectory defining slit of the consecutive 90° arc-shaped magnetic deflection flight tube of the smoothly bent magnetic deflection flight tube assembly intersects the origin of the radius of curvature of the magnetic field of the first magnetic field generating apparatus, and a line connecting the second ion trajectory defining slit of the consecutive 90° arc-shaped magnetic deflection flight tube of the smoothly bent magnetic deflection flight tube assembly intersects the origin of the radius of curvature of the magnetic field of the second magnetic field generating apparatus.

YET STILL ANOTHER OBJECT of the present invention is to provide a mass spectrometer wherein when the first magnetic field generating apparatus and the second magnetic field generating apparatus are in the low intensity position, the distance between the ion source exit slit of the first chamber of the smoothly bent magnetic deflection flight tube assembly and the entrance of the first magnet field generating apparatus, the distance between the exit of the first magnetic field generating apparatus and the entrance of the second magnetic field generating apparatus, and the distance between the exit of the second magnetic field generating apparatus and the collecting slit of the second chamber of the smoothly bent magnetic deflection flight tube assembly, are each equal to the radius of curvature of the magnetic field of said first magnetic field generating means of the 90° arc-shaped magnetic deflection flight tube of the smoothly bent magnetic deflection flight tube assembly.

STILL YET ANOTHER OBJECT of the present invention is to provide a method of using a mass spectrometer having a single magnet assembly that includes the steps of vacuumizing a 90° arc-shaped magnetic deflection flight tube assembly of the portable magnetic sector mass spectrometer, entering a material to be analyzed into the vacuumized 90° arc-shaped magnetic deflection flight tube assembly, ionizing the material to be analyzed by an ion source of the portable magnetic sector mass spectrometer and forming an ion trajectory having a width contained in the vacuumized 90° arc-shaped magnetic deflection flight tube assembly wherein the ion source has a half angle of divergence $\alpha$, an energy dispersion $\Delta V$, and an accelerating potential V, defining the width of the ion trajectory leaving the ion source by an ion source exit slit having a width S from which the ion trajectory is emitted with a kinetic energy equal to the accelerating potential V of the ion source, collimating the defined ion trajectory leaving the ion source by an ion trajectory defining slit, entering the collimated ion trajectory into a 90° magnetic field having a radius of curvature R which is created by a pair of parallel and spaced apart high energy product density magnetic 90° sectors with linear or circular pole tips shaped as a square, circular, or relevant sections thereof, bending the collimated ion trajectory entering the 90° magnetic field and being momentum selected, defining further a width X of the bent ion trajectory leaving the 90° magnetic field by an ion trajectory collection defining slit, and receiving the further defined ion trajectory leaving the ion trajectory collection defining slit by an ion detector.

YET STILL ANOTHER OBJECT of the present invention is to provide a method of using a mass spectrometer having a single magnet assembly that further includes the step of determining the width X of the further defined ion trajectory leaving the ion trajectory collection defining slit when $\alpha=0$, so that $X=R(1-\cos(S/R))+(\Delta V/V)R$.

STILL YET ANOTHER OBJECT of the present invention is to provide a method of using a mass spectrometer having a single magnet assembly that further includes the step of determining the width X of the further defined ion trajectory leaving the ion trajectory collection defining slit when $\alpha\neq0$, so that $X=R(1-\cos(S/R))+2\alpha R+(\Delta V/V)R$.

YET STILL ANOTHER OBJECT of the present invention is to provide a method of using a mass spectrometer having a pair of tandem magnet assemblies that includes the steps of vacuumizing a consecutive 90° arc-shaped magnetic deflection flight tube assembly of the portable magnetic sector mass spectrometer, entering a material to be analyzed into the vacuumized consecutive 90° arc-shaped magnetic deflection flight tube assembly, ionizing the material to be analyzed by an ion source of the portable magnetic sector mass spectrometer and forming an ion trajectory having a width contained in the vacuumized consecutive 90° arc-shaped magnetic deflection flight tube assembly wherein the ion source has a half angle of divergence $\alpha$, an energy dispersion $\Delta V$, and an accelerating potential V, defining the width of the ion trajectory leaving the ion source by an ion source exit slit having a width S from which the ion trajectory is emitted with a kinetic energy equal to the accelerating potential V of the ion source, collimating the defined ion trajectory leaving the ion source by a first ion trajectory defining slit, entering the collimated ion trajectory into a first 90° magnetic field having a radius of curvature R which is created by a pair of parallel and spaced apart high energy product density magnetic 90° sectors with linear or circular pole tips shaped as square, circular, or appropriate sections thereof, bending the collimated ion trajectory entering the first 90° magnetic field and being momentum selected, defining further the width of the bent ion trajectory leaving the first 90° magnetic field by an ion trajectory focusing slit that has a width $S_f$, entering the further defined ion trajectory into a second 90° magnetic field that has a radius of curvature R which is created by a pair of parallel and spaced apart high energy product density magnetic 90° sector with linear or circular pole tips, bending the further defined ion trajectory entering the second 90° magnetic field and again being momentum selected, defining further a width X of the bent ion trajectory leaving the second 90° magnetic field by an ion trajectory collection defining slit having a width $S_c$, and receiving the further defined ion trajectory leaving the ion trajectory collection defining slit by an ion detector or collection device.

STILL YET ANOTHER OBJECT of the present invention is to provide a method of using a mass spectrometer having a pair of tandem magnet assemblies that further includes the step of determining the width X of the further defined ion trajectory leaving the ion trajectory collection defining slit when $\alpha=0$, so that $X=(\Delta V/V)R$.

YET STILL ANOTHER OBJECT of the present invention is to provide a method of using a mass spectrometer having a pair of tandem magnet assemblies that further includes the step of determining the width X of the further defined ion trajectory leaving the ion trajectory collection defining slit when $\alpha=0$, and $S_f=S_c$, so that $X=S_c+(\Delta V/V)R$.

FINALLY, STILL YET ANOTHER OBJECT of the present invention is to provide a method of using a mass spectrometer having a pair of tandem magnet assemblies that further includes the step of determining the width X of the further defined ion trajectory leaving the ion trajectory collection defining slit when $\alpha\neq0$, so that $X=2\alpha R+(\Delta V/V)R$.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the high resolution embodiment of the present invention utilizing a pair of tandem magnets for high resolution;

FIG. 2 is a diagrammatic top plan view of the base portion of the high resolution embodiment of the present invention taken in the direction of arrow 2 in FIG. 1;

FIG. 3 is a cross sectional view taken on line 3—3 in FIG. 2;

FIG. 4 is a cross sectional view, with parts broken away, taken on line 4—4 in FIG. 2;

FIG. 4A is an enlarged top plan view, with parts broken away, of the area enclosed by the circle identified by arrow 4A in FIG. 2;

FIG. 5 is a cross sectional view, with parts broken away, taken on line 5—5 in FIG. 2;

FIG. 6 is an enlarged diagrammatic elevational view, with parts broken away, taken in the direction of arrow 6 in FIG. 2;

FIG. 7 is a diagrammatic top plan view, with parts broken away, taken in the direction of arrow 7 in FIG. 1;

FIG. 7A is a diagrammatic elevational view, with parts broken away, taken in the direction of arrow 7A in FIG. 7;

LIST OF PREFERENCE NUMERALS UTILIZED IN THE DRAWING

High Resolution Embodiment

Figure 8:
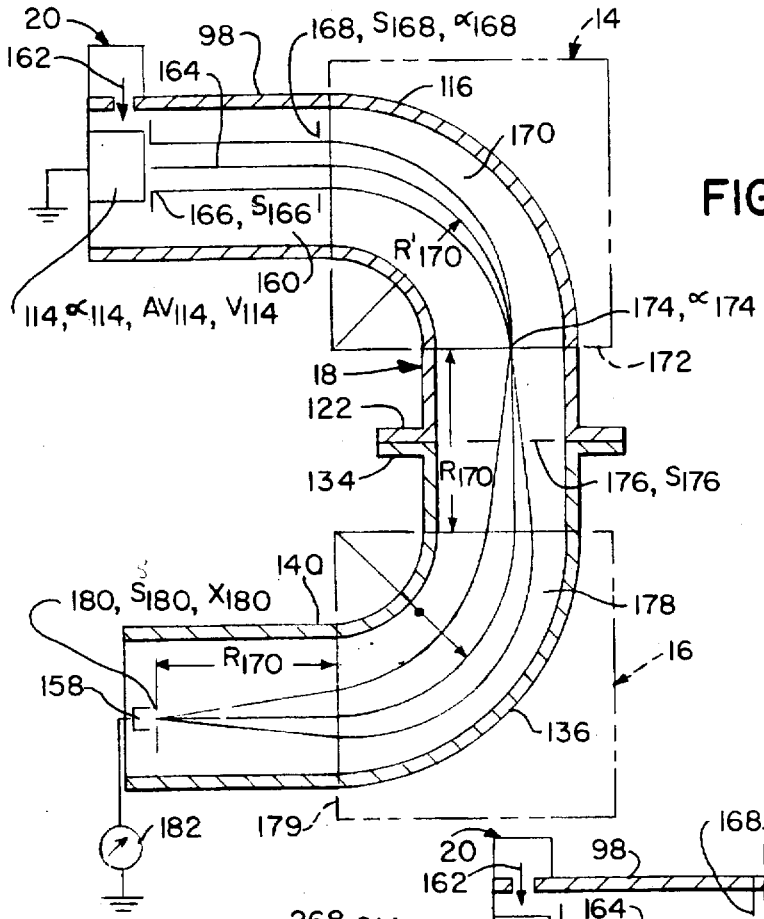
FIG. 8 is an enlarged cross sectional view taken on line 8—8 in FIG. 1 illustrating the ion trajectory leaving the ion source of the preferred embodiment of the present invention with negligible angular divergence.

10 small magnetic sector mass spectrometer of the present invention
12 rectangular-shaped base portion
14 first slidably mounted magnet assembly
16 second slidably mounted magnet assembly
18 removably mounted shaped magnetic deflection flight tube assembly
20 material to be analyzed input port and vacuum port assembly
22 base portion upper surface
24 base portion upper surface front area
26 base portion upper surface back area
28 base portion lower surface
30 base portion lower surface back area 32 pair of base portion short sides
34 pair of base portion lower surface back area longitudinally spaced-apart diamond-shaped throughbores
38 pair of base portion lower surface back area laterally spaced short side throughbores
40 pair of base portion short side C-channels
42 plurality of C-channel affixing screws
44 thin rectangular-shaped plate
46 plate frontal area
48 plate frontal area front edge
50 pair of plate short sides
52 plurality of plate affixing screws
54 pair of plate longitudinally positioned semi-circular recesses
56 laterally slidably mounted substantially U-shaped elongated track
58 track intermediate portion
60 pair of track intermediate portion longitudinally oriented and longitudinally spaced-apart slots
62 pair of track short sides
64 pair of track short side laterally oriented slots
66 two pair of track affixing screws
68 first substantially C-shaped inwardly opening soft iron highly permeable yoke
70 first yoke vertical part
72 first yoke upper horizontal part
73 first yoke upper horizontal part inner surface
74 plurality of first yoke upper horizontal part affixing screws
76 first yoke lower horizontal part
77 first yoke lower horizontal part inner surface
78 first slidably mounted magnet assembly affixing screw
80 first yoke upper horizontal neodymium iron boron magnetic 90° sector with linear or circular pole tips
81 first yoke lower horizontal neodymium iron boron magnetic 90° sector with linear or circular pole tips
82 second substantially C-shaped inwardly opening soft iron highly permeable yoke
84 second yoke vertical part
86 second yoke upper horizontal part
87 second yoke upper horizontal part inner surface
88 plurality of second yoke upper horizontal part affixing screws
89 magnet assembly fine longitudinal adjustment assembly
90 second yoke lower horizontal part
91 second yoke lower horizontal part inner surface
92 second slidably mounted magnet assembly affixing screw
93 rotatively mounted magnet assembly fine longitudinal adjustment assembly handle
94 second yoke upper horizontal neodymium iron boron magnetic 90° sector with linear or circular pole tips
96 second yoke lower horizontal neodymium iron boron magnetic 90° sector with linear or circular pole tips
98 first chamber
100 first chamber open distal port end
102 first chamber distal port end flange
104 first chamber closed proximal end
106 first chamber closed proximal end centrally disposed rectangular-shaped throughbore
107 first chamber closed proximal end rectangular-shaped throughbore perimeter
108 first removably mounted chamber vacuum sealed section
110 plurality of first chamber vacuum sealed section affixing screws
112 plurality of outwardly extending first vacuum sealed section isolated, and vacuum sealed electrodes
114 ion source
116 first 90° arc-shaped rectangular cross sectioned magnetic deflection flight tube
118 first magnetic deflection flight tube open proximal end
119 first 90° arc-shaped magnetic deflection flight tube central radius of curvature
120 first magnetic deflection flight tube open distal end
122 first magnetic deflection flight tube distal end circular flange
124 first magnetic deflection flight tube distal end flange centrally disposed rectangular-shaped throughbore
126 second 90° arc-shaped rectangular cross sectioned magnetic deflection flight tube
128 second magnetic deflection flight tube open proximal end
130 second magnetic deflection flight tube open distal end
132 second 90° arc-shaped magnetic deflection flight tube central radius of curvature
134 second magnetic deflection flight tube distal end circular flange
136 second magnetic deflection flight tube distal end flange centrally disposed rectangular-shaped throughbore
138 plurality of magnetic deflection flight tube distal end flange securing screws
140 second chamber
142 second chamber open distal port end
144 second chamber distal port end flange
146 second chamber closed proximal end
148 second chamber closed proximal end centrally disposed rectangular-shaped throughbore
150 second chamber closed proximal end rectangular-shaped throughbore perimeter
152 second removably mounted chamber vacuum sealed section
154 plurality of second chamber disk affixing screws
156 plurality of outwardly extending second vacuum sealed section isolated, and vacuum sealed electrodes
158 ion detector
160 magnetic deflection flight tube assembly interior vacuum chamber
162 material to be analyzed
164 ion trajectory
166 ion source exit slit
168 first ion trajectory defining slit
170 first magnet assembly 90° magnetic field
172 first magnetic assembly 90° pole piece exit face
174 ion trajectory first focal point
176 second ion trajectory defining slit
178 second magnet assembly 90° magnetic field
179 second magnetic assembly 90° pole piece exit face
180 third ion trajectory collection defining slit
182 electrometer
$R_{170}$ first magnet assembly 90° magnetic field radius of curvature
$R'_{170}$ low intensity first magnet assembly 90° magnetic field radius of curvature
$R_{178}$ second magnet assembly 90° magnetic field radius of curvature
$R'_{178}$ low intensity second magnet assembly 90° magnetic field radius of curvature
$S_{166}$ ion source exit slit width
$S_{168}$ first ion trajectory defining slit width
$S_{176}$ second ion trajectory defining slit width
$S_{180}$ third ion trajectory collection defining slit width
$X^{170}$ low intensity distance
$X_{180}$ third ion trajectory collection defining slit ion trajectory width $V_{114}$ ion source accelerating potential
$\alpha_{114}$ half angle of angular divergence
$\alpha_{168}$ half angle of divergence for focusing
$\alpha_{174}$ ion trajectory first focal point half angle of divergence
$\Delta V_{114}$ ion source energy dispersion Alternate Embodiment

210 small magnetic sector mass spectrometer of the present invention
212 thin rectangular-shaped base portion
214 fixedly mounted magnet assembly
218 removably mounted magnetic deflection flight tube assembly
220 material to be analyzed input port and vacuum port assembly
268 substantially C-shaped inwardly opening soft iron highly permeable yoke
270 yoke vertical part
272 yoke upper horizontal part
273 yoke upper horizontal part inner surface
274 plurality of yoke upper horizontal part affixing screws
276 yoke lower horizontal part
277 yoke lower horizontal part inner surface
280 yoke upper horizontal neodymium iron boron magnetic 90° sector with linear or circular pole tips
281 yoke lower horizontal neodymium iron boron magnetic 90° sector with linear or circular pole tips
298 first chamber
300 first chamber open distal port end
302 first chamber distal port end flange
304 first chamber closed proximal end
306 first chamber closed proximal end centrally disposed rectangular-shaped throughbore
307 first chamber closed proximal end rectangular-shaped throughbore perimeter
308 first removably mounted chamber vacuum sealed section
310 plurality of first vacuum sealed section affixing screws
312 plurality of outwardly extending first vacuum sealed section isolated, and vacuum sealed electrodes
314 ion source
316 90° arc-shaped rectangular cross sectioned magnetic deflection flight tube
318 magnetic deflection flight tube open proximal end
320 first magnetic deflection flight tube open distal end
319 90° arc-shaped magnetic deflection flight tube central radius of curvature
340 second chamber
342 second chamber open distal port end
344 second chamber distal port end flange
346 second chamber closed proximal end
348 second chamber closed proximal end centrally disposed rectangular-shaped throughbore
350 second chamber closed proximal end rectangular-shaped throughbore perimeter
352 second removably mounted chamber vacuum sealed section
354 plurality of second chamber vacuum sealed section affixing screws
356 plurality of outwardly extending second vacuum sealed section isolated, and vacuum sealed electrodes
358 ion detector
360 magnetic deflection flight tube assembly interior vacuum chamber
362 material to be analyzed
364 ion trajectory
366 ion source exit slit
368 ion trajectory defining slit
370 magnet assembly 90° magnetic field
372 magnetic assembly 90° pole piece exit face
380 third ion trajectory collection defining slit
382 electrometer
$R_{370}$ magnet assembly 90° magnetic field radius of curvature
$S_{366}$ ion source exit slit width
$S_{368}$ ion trajectory defining slit width
$S_{380}$ third ion trajectory collection defining slit width
$V_{314}$ ion source accelerating potential
$X_{380}$ third ion trajectory collection defining slit ion trajectory width
$\alpha_{314}$ half angle of divergence
$\alpha_{368}$ half angle of divergence for focusing
$\Delta V_{314}$ ion source energy dispersion

DETAILED DESCRIPTION OF THE PREFERRED EMBODIMENTS

The prototype on which the present invention is based is a VEECO HE (mass 4) leak detection mass spectrometer unit modified with high performance magnets and appropriate slit geometry that allows operation at much higher masses, perhaps 200.

When I computed the ion trajectory, I observed that focusing of the parallel component of the ion beam at the exit of the first magnet could provide useful resolution at high transmission with a small radius of curvature with the use of only a single magnet and I have demonstrated the concept in the laboratory.

Referring now to the figures in which like numerals indicate like parts and particularly to FIG. 1, the high resolution tandem magnet embodiment of the small magnetic sector mass spectrometer of the present invention is shown generally at 10 and includes a thin rectangular-shaped base portion 12, a first slidably mounted magnet assembly 14 that is slidably mounted to the thin rectangular-shaped base portion 12 and has a magnetic field of 6000 Gauss, a second slidably mounted magnet assembly 16 that is slidably mounted to the thin rectangular-shaped base portion 12 and positioned tandem to, and in opposing alignment with, the first slidably mounted magnet assembly 14 and also has a magnetic field of 6000 Gauss, a removably mounted shaped magnetic deflection flight tube assembly 18 that is removably mounted to the thin rectangular-shaped base portion 12, and a material to be analyzed input port and vacuum port assembly 20.

The first slidably mounted magnet assembly 14 and the second slidably mounted magnet assembly 16 may be positioned in proximity to (in a high intensity position where exit slit focusing is applied), or external to (in a low intensity position using angular focus), the removably mounted shaped magnetic deflection flight tube assembly 18.

The configuration of the high resolution embodiment of the thin rectangular-shaped base portion 12 and related components can best be seen in FIGS. 2 through 6, and as such, will be discussed with reference thereto.

The thin rectangular-shaped base portion 12 has a base portion upper surface 22 with a base portion upper surface front area 24 and a base portion upper surface back area 26, a base portion lower surface 28 with a base portion lower surface back area 30, and a pair of base portion short sides 32.

The base portion lower surface back area 30 of the base portion lower surface 28 of the thin rectangular-shaped base portion 12 has a pair of base portion lower surface back area longitudinally spaced-apart diamond-shaped throughbores 34 that extend upwardly and completely through the base portion upper surface back area 26 of the base portion upper surface 22 of the thin rectangular-shaped base portion 12.

The base portion lower surface back area 30 of the base portion lower surface 28 of the thin rectangular-shaped base portion 12 further has, in the proximity of each of the pair of the base portion short sides 32 of the thin rectangular-shaped base portion 12, a pair of base portion lower surface back area laterally spaced short side throughbores 38 that extend upwardly completely through the base portion upper surface back area 26 of the base portion upper surface 22 of the thin rectangular-shaped base portion Each of a pair of base portion short side C-channels 40 is affixed to a respective one of the pair of base portion short sides 32 of the thin rectangular-shaped base portion 12, by a plurality of C-channel affixing screws 42, and provides lateral reinforcement therefor.

A thin rectangular-shaped plate 44 has a plate frontal area 46 with a plate frontal area front edge 48, and a pair of plate short sides 50. The thin rectangular-shaped plate 44 is affixed to the base portion upper surface front area 24 of the base portion upper surface 22 of the thin rectangular-shaped base portion 12 by a plurality of plate affixing screws 52, and provides longitudinal reinforcement therefor.

A pair of plate longitudinally positioned semi-circular recesses 54 are disposed in the plate frontal area 46 of the thin rectangular-shaped plate 44 and open into the plate frontal area front edge 48 of the plate frontal area 46 of the thin rectangular-shaped plate 44.

A laterally slidably mounted substantially U-shaped elongated track 56 has a track intermediate portion 58 with a pair of track intermediate portion longitudinally oriented and longitudinally spaced-apart slots 60, and a pair of track short sides 62. Each of the pair of track short sides 62 of the laterally slidably mounted substantially U-shaped elongated track 56 has a pair of track short side laterally oriented slots 64 disposed in proximity thereof.

The laterally slidably mounted substantially U-shaped elongated track 56 is laterally slidably mounted to the base portion upper surface back area 26 of the base portion upper surface 22 of the thin rectangular-shaped base portion 12 by two pair of track affixing screws 66. Each pair of the two pair of track affixing screws 66 pass freely through a respective one of the track short side laterally oriented slots 64 of the pair of track short sides 62 of the laterally slidably mounted substantially U-shaped elongated track 56 and threadably enter a respective pair of the base portion lower surface back area laterally spaced short side throughbores 38 of the base portion lower surface back area 30 of the base portion lower surface 28 of the thin rectangular-shaped base portion 12, so that the laterally slidably mounted substantially U-shaped elongated track 56 is laterally slidable relative to the thin rectangular-shaped base portion 12.

The laterally slidably mounted substantially U-shaped elongated track 56 is positioned on the base portion upper surface back area 26 of the base portion upper surface 22 of the thin rectangular-shaped base portion 12 with each of the pair of track intermediate portion longitudinally oriented and longitudinally spaced-apart slots 60 of the track intermediate portion 58 of the laterally slidably mounted substantially U-shaped elongated track 56 opening into a respective one of the pair of base portion lower surface back area longitudinally spaced-apart diamond-shaped throughbores 34 of the base portion lower surface back area 30 of the base portion lower surface 28 of the thin rectangular-shaped base portion 12.

The configuration of the preferred embodiment of the first slidably mounted magnet assembly 14, the second slidably mounted magnet assembly 16, the removably mounted shaped magnetic deflection flight tube assembly 18 can best be seen in FIGS. 1 through 2A, and as such, will be discussed with reference thereto.

The first slidably mounted magnet assembly 14 includes a first substantially C-shaped inwardly opening soft iron highly permeable yoke 68 that has a first yoke vertical part 70, a first yoke upper horizontal part 72 with a first yoke upper horizontal part inner surface 73 that is affixed to the first yoke vertical part 70 of the first substantially C-shaped inwardly opening soft iron highly permeable yoke 68 by a plurality of first yoke upper horizontal part affixing screws 74, and a first yoke lower horizontal part 76 with a first yoke lower horizontal part inner surface 77 that is affixed to the first yoke vertical part 70 of the first substantially C-shaped inwardly opening soft iron highly permeable yoke 68 by a plurality of yoke lower horizontal part affixing screws (not shown but identical to the plurality of first yoke upper horizontal part affixing screws 74).

The first yoke lower horizontal part 76 of the first substantially C-shaped inwardly opening soft iron highly permeable yoke 68 is displaced a distance below, and parallel to, the first yoke upper horizontal part 72 of the first substantially C-shaped inwardly opening soft iron highly permeable yoke 68.

The first yoke lower horizontal part 76 of the first substantially C-shaped inwardly opening soft iron highly permeable yoke 68 is longitudinally slidably received by the laterally slidably mounted substantially U-shaped elongated track 56, so that the first slidably mounted magnet assembly 14 is longitudinally slidable relative to the thin rectangular-shaped base portion 12.

Once the desired longitudinal position of the first slidably mounted magnet assembly 14 has been manually achieved, a first slidably mounted magnet assembly affixing screw 78 that passes through a respective one of the pair of base portion lower surface back area longitudinally spaced diamond-shaped throughbores 34 of the base portion lower surface back area 30 of the base portion lower surface 28 of the thin rectangular-shaped base portion 12 and passes through a respective one of the pair of track intermediate portion longitudinally oriented and longitudinally spaced-apart slots 60 of the track intermediate portion 58 of the laterally slidably mounted substantially U-shaped elongated track 56 and enters the first yoke lower horizontal part 76 of the first substantially C-shaped inwardly facing soft iron highly permeable yoke 68 is tightened (see FIG. 4).

The first slidably mounted magnet assembly 14 further includes a first yoke upper horizontal neodymium iron boron magnetic 90° sector with linear or circular pole tips 80 that is affixed preferably by epoxy material or screws to the first yoke upper horizontal part inner surface 73 of the first yoke upper horizontal part 72 of the first substantially C-shaped inwardly opening soft iron highly permeable yoke 68 and whose entry and exit faces are 90° relative to each other.

The first slidably mounted magnet assembly 14 further includes a first yoke lower horizontal neodymium iron boron magnetic 90° sector with linear or circular pole tips 81 that is affixed preferably by epoxy or screws to the first yoke lower horizontal part inner surface 77 of the first yoke lower horizontal part 76 of the first substantially C-shaped inwardly opening soft iron highly permeable yoke 68 and whose entry and exit faces are 90° relative to each other.

The first yoke lower horizontal neodymium iron boron magnetic 90° sector with linear or circular pole tips 81 of the first substantially C-shaped inwardly opening soft iron highly permeable yoke 68 is positioned a distance below, and parallel to, the first yoke upper horizontal neodymium iron boron magnetic 90° sector with linear or circular pole tips 80 of the first substantially C-shaped inwardly opening soft iron highly permeable yoke 68.

The second slidably mounted magnet assembly 16 includes a second substantially C-shaped inwardly opening soft iron highly permeable yoke 82 that has a second yoke vertical part 84, a second yoke upper horizontal part 86 with a second yoke upper horizontal part inner surface 87 that is affixed to the second yoke vertical part 84 of the second substantially C-shaped inwardly opening soft iron highly permeable yoke 82 by a plurality of second yoke upper horizontal part affixing screws 88, and a second yoke lower horizontal part 90 with a second yoke lower horizontal part inner surface 91 that is affixed to the second yoke vertical part 84 of the second substantially C-shaped inwardly opening soft iron highly permeable yoke 82 by a plurality of second yoke lower horizontal part affixing screws (not shown but identical to the plurality of first yoke upper horizontal part affixing screws 74).

The second yoke lower horizontal part 90 of the second substantially C-shaped inwardly opening soft iron highly permeable yoke 82 is displaced a distance below, and parallel to, the second yoke upper horizontal part 86 of the second substantially C-shaped inwardly opening soft iron highly permeable yoke 82.

The second yoke lower horizontal part 90 of the second substantially C-shaped inwardly opening soft iron highly permeable yoke 82 is longitudinally slidably received by the laterally slidably mounted substantially U-shaped elongated track 56, so that the second slidably mounted magnet assembly 16 is longitudinally slidable relative to the thin rectangular-shaped base portion 12.

A magnet assembly fine longitudinal adjustment assembly 89 having a rotatively mounted magnet assembly fine longitudinal adjustment assembly handle 93 is disposed through the second yoke vertical part 84 of the second substantially C-shaped inwardly opening soft iron highly permeable yoke 82, and when rotated, finally adjusts the longitudinal position of the second slidably mounted magnet assembly 16 relative to the removably mounted shaped magnetic deflection flight tube assembly 18. The operation of the magnet assembly fine longitudinal adjustment assembly 89 is similar to that of a caliper and is calibrated as such.

Once the desired longitudinal position of the second slidably mounted magnet assembly 14 has been manually achieved, a second slidably mounted magnet assembly affixing screw 92, that passes through a respective one of the pair of base portion lower surface back area longitudinally spaced diamond-shaped throughbores 34 of the base portion lower surface back area 30 of the base portion lower surface 28 of the thin rectangular-shaped base portion 12 and passes through a respective one of the pair of track intermediate portion longitudinally oriented and longitudinally spaced-apart slots 60 of the track intermediate portion 58 of the laterally slidably mounted substantially U-shaped elongated track 56 and enters the second yoke lower horizontal part 90 of the second substantially C-shaped inwardly opening soft iron highly permeable yoke 82 is tightened (see FIG. 4).

The second slidably mounted magnet assembly 16 further includes a second yoke upper horizontal neodymium iron boron magnetic 90° sector with linear or circular pole tips 94 that is affixed preferably by epoxy or screws to the second yoke upper horizontal part inner surface 87 of the second yoke upper horizontal part 86 of the second substantially C-shaped inwardly opening soft iron highly permeable yoke 82 and whose entry and exit faces are 90° relative to each other.

The second slidably mounted magnet assembly 16 further includes a second yoke lower horizontal neodymium iron boron magnetic 90° sector with linear or circular pole tips 96 that is affixed preferably by epoxy or screws to the second yoke lower horizontal part inner surface 91 of the second yoke lower horizontal part 90 of the second substantially C-shaped inwardly opening soft iron highly permeable yoke 82 and whose entry and exit faces are 90° relative to each other.

The second yoke lower horizontal neodymium iron boron magnetic 90° sector with linear or circular pole tips 96 is displaced a distance below, and parallel to, the second yoke upper horizontal neodymium iron boron magnetic 90° sector with linear or circular pole tips 94.

Since the first slidably mounted magnet assembly 14 and the second slidably mounted magnet assembly 16 are longitudinally slidable relative to the laterally slidably mounted substantially U-shaped elongated track 56, and since the laterally slidably mounted substantially U-shaped elongated track 56 is laterally slidably mounted to the thin rectangular-shaped base portion 12, the lateral position of the first slidably mounted magnet assembly 14 and the lateral position of the second slidably mounted magnet assembly 16 can be jointly achieved by laterally moving the laterally slidably mounted substantially U-shaped elongated track 56 relative to the thin rectangular-shaped base portion 12 and tightening the two pair of track affixing screws 66.

Due to the aforementioned longitudinal and lateral mobility of the first slidably mounted magnet assembly 14 and the second slidably mounted magnet assembly 16, the first slidably mounted magnet assembly 14 and the second slidably mounted magnet assembly 16 are manually movable from a high intensity position where the removably mounted shaped magnetic deflection flight tube assembly 18 is positioned through both the first slidably mounted magnet assembly 14 and the second slidably mounted magnet assembly 16, 45° diagonally outward, to a low intensity position where the removably mounted magnetic deflection flight tube assembly is positioned external to both the first slidably mounted magnet assembly 14 and the second slidably mounted magnet assembly 16.

The removably mounted shaped magnetic deflection flight tube assembly 18 includes a first chamber 98 that has a first chamber open distal port end 100 with a first chamber distal port end flange 102 that extends outwardly from, and surrounds, the first chamber open distal port end 100 of the first chamber 98, and a first chamber closed proximal end 104 with a first chamber closed proximal end centrally disposed rectangular-shaped throughbore 106 that has a first chamber closed proximal end rectangular-shaped throughbore perimeter 107.

A first removably mounted chamber vacuum sealed section is removably mounted to the first chamber 98 and selectively opens and closes the first chamber open distal port end 100 of the first chamber 98, so that the components contained in the first chamber 98 can be readily accessed. The first removably mounted chamber vacuum sealed section 108 is vacuum sealed to the to the first chamber 98 by the use of, but not limited to, VITON "O" rings or other approaches such as metal seal technology.

When the first removably mounted chamber vacuum sealed section 108 of the first chamber 98 closes the first chamber open distal port end 100 of the first chamber 98, the first removably mounted chamber vacuum sealed section 108 of the first chamber 98 mates with the first chamber distal port end flange 102 of the first chamber open distal port end 100 of the first chamber 98 and is removably secured thereto by a plurality of first chamber vacuum sealed section affixing screws 110.

The first removably mounted chamber thin section 108 of the first chamber 98 has a plurality of outwardly extending first vacuum sealed section isolated, and vacuum sealed electrodes 112 extending outwardly therefrom.

Contained in the first chamber 98 is an ion source 114 that may be a Nier-type electron bombardment source using an accelerating voltage of 70 to 1000 volts. The ion source 114 is be positive or negative ions and is in electrical communication with the plurality of outwardly extending first vacuum sealed section isolated, and vacuum sealed electrodes 112 of the first removably mounted chamber thin section 108 of the first chamber 98 which in turn are in electrical communication with different potentials to power the various components of the ion source 114.

The removably mounted shaped magnetic deflection flight tube assembly 18 further includes a first 90° arc-shaped rectangular cross sectioned magnetic deflection flight tube 116 with a first magnetic deflection flight tube open proximal end 118 that extends from the first chamber closed proximal end rectangular-shaped throughbore perimeter 107 of the first chamber closed proximal end centrally disposed rectangular-shaped throughbore 106 of the first chamber 98 with the interior of the first chamber 98 being in communication with the interior of the first arc-shaped rectangular cross sectioned magnetic deflection flight tube 116, a first magnetic deflection flight tube open distal end 120 that is oriented 90° to the first magnetic deflection flight tube open proximal end 118 of the first 90° arc-shaped rectangular cross sectioned magnetic deflection flight tube 116, and a first 90° magnetic deflection flight tube central radius of curvature 119 of 3.2 cm.

The first 90° arc-shaped rectangular cross sectioned magnetic deflection flight tube 116 of the removably mounted shaped magnetic deflection flight tube assembly 18 is not a highly electrically conductive metal preferably stainless steel and may moreover be constructed in an inexpensive way by using tubing compressed in the appropriate area to fit through the first slidably mounted magnet assembly 14.

A first magnetic deflection flight tube distal end flange 122 with a first magnetic deflection flight tube distal end flange centrally disposed rectangular-shaped throughbore 124 extends outwardly from, and surrounds, the first magnetic deflection flight tube open distal end 120 of the first 90° arc-shaped rectangular cross sectioned magnetic deflection flight tube 116.

The removably mounted shaped magnetic deflection flight tube assembly 18 further includes a second 90° arc-shaped rectangular cross sectioned magnetic deflection flight tube 126 with a second magnetic deflection flight tube open proximal end 128, a second magnetic deflection flight tube open distal end 130 that is oriented 90° to the second magnetic deflection flight tube open proximal end 128 of the second 90° arc-shaped rectangular cross sectioned magnetic deflection flight tube 126, and a second 90° arc-shaped magnetic deflection flight tube central radius of curvature 132 that is equal to the first 90° arc-shaped magnetic deflection flight tube central radius of curvature 119 of the first 90° arc-shaped rectangular cross sectioned magnetic deflection flight tube 116.

The second 90° arc-shaped rectangular cross sectioned magnetic deflection flight tube 126 of the removably mounted shaped magnetic deflection flight tube assembly 18 is not a highly electrically conductive metal preferably stainless steel and may moreover be constructed in an inexpensive way by using tubing compressed in the appropriate area to fit through the second slidably mounted magnet assembly 16.

The second 90° arc-shaped rectangular cross sectioned magnetic deflection flight tube 126 and the first 90° arc-shaped rectangular cross sectioned magnetic deflection flight tube 116 lie in the same plane and the first magnetic deflection flight tube open proximal end 118 of the first 90° arc-shaped rectangular cross sectioned magnetic deflection flight tube 116 and the second magnetic deflection flight tube open proximal end 128 of the second 90° arc-shaped rectangular cross sectioned magnetic deflection flight tube 126 lie in the same plane, so that an ionized material entering the first magnetic deflection flight tube open proximal end 118 of the first 90° arc-shaped rectangular cross sectioned magnetic deflection flight tube 116 will exit the second magnetic deflection flight tube open proximal end 128 of the second 90° arc-shaped rectangular cross sectioned magnetic deflection flight tube 126 in a direction 180° from its entry.

A second magnetic deflection flight tube distal end circular flange 134 with a second magnetic deflection flight tube distal end flange centrally disposed rectangular-shaped throughbore 136 extends outwardly from, and surrounds, the second magnetic deflection flight tube open distal end 130 of the second 90° arc-shaped rectangular cross sectioned magnetic deflection flight tube 126.

The second magnetic deflection flight tube distal end circular flange 134 of the second magnetic deflection flight tube open distal end 130 of the second 90° arc-shaped rectangular cross sectioned magnetic deflection flight tube 126 is removably secured to the first magnetic deflection flight tube distal end circular flange 122 of the first magnetic deflection flight tube open distal end 120 of the first 90° arc-shaped rectangular cross sectioned magnetic deflection flight tube 116 with the interior of the first 90° arc-shaped rectangular cross sectioned magnetic deflection flight tube 116 being in communication with the interior of the second 90° arc-shaped rectangular cross sectioned magnetic deflection flight tube 126, by a plurality of magnetic deflection flight tube distal end flange securing screws 138, so that the components contained in the joint can be readily accessed.

The removably mounted shaped magnetic deflection flight tube assembly 18 further includes a second chamber 140 that has a second chamber open distal port end 142 with a second chamber distal port end flange 144 that extends outwardly from, and surrounds, the second chamber open distal port end 142 of the second chamber 140, and a second chamber closed proximal end 146 with a second chamber closed proximal end centrally disposed rectangular-shaped throughbore 148 that has a second chamber closed proximal end rectangular-shaped throughbore perimeter 150.

The second chamber 140 and the first chamber 98 lie in the same plane and are displaced a distance from each other in parallel relationship.

The second magnetic deflection flight tube open proximal end 128 of the second 90° arc-shaped rectangular cross sectioned magnetic deflection flight tube 126 extends from the second chamber closed proximal end rectangular-shaped throughbore perimeter 150 of the second chamber closed proximal end centrally disposed rectangular-shaped throughbore 148 of the second chamber 140 with the interior of the second 90° arc-shaped rectangular cross sectioned magnetic deflection flight tube 126 being in communication with the interior of the second chamber 140.

A second removably mounted chamber vacuum sealed section 152 is removably mounted to the second chamber 140 and selectively opens and closes the second chamber open distal port end 142 of the second chamber 140, so that the components contained in the second chamber 140 can be readily accessed. The second removably mounted chamber vacuum sealed section 152 is vacuum sealed to the to the second chamber 140 by the use of, but not limited to, VITON "O" rings or other approaches such as metal seal technology.

When the second removably mounted chamber vacuum sealed section 152 of the second chamber 140 closes the second chamber open distal port end 144 of the second chamber 140, the second removably mounted chamber vacuum sealed section 152 of the second chamber 140 mates with the second chamber distal port end flange 144 of the second chamber open distal port end 142 of the second chamber 140 and is removably secured thereto by a plurality of second chamber vacuum sealed section affixing screws 154.

The second removably mounted chamber vacuum sealed section 152 of the second chamber 140 has a plurality of outwardly extending second vacuum sealed section isolated, and vacuum sealed electrodes 156 extending outwardly therefrom.

Contained in the second chamber 140 is an ion detector 158 that may be a Faraday cup or an electron multiplier or other ion detection device. The ion detector 158 is in electrical communication with the plurality of outwardly extending second vacuum sealed section isolated, and vacuum sealed electrodes 156 of the second removably mounted chamber vacuum sealed section 152 of the second chamber 140 which in turn are in electrical communication with an electrometer or other output device (not shown).

Since the interior of the first chamber 98 is in communication with the interior of the first 90° arc-shaped rectangular cross sectioned magnetic deflection flight tube 116, and since the interior of the first 90° arc-shaped rectangular cross sectioned magnetic deflection flight tube 116 is in communication with the interior of the second 90° arc-shaped rectangular cross sectioned magnetic deflection flight tube 126, and since the interior of the second 90° arc-shaped rectangular cross sectioned magnetic deflection flight tube 126 is in communication with the interior of the second chamber 140, the interior of the removably mounted shaped magnetic deflection flight tube assembly 18 is continuous and contains a magnetic deflection flight tube assembly interior vacuum chamber 160 which operates at a pressure of less than 3×10E-5 Torr.

By rotating the rotatively mounted magnet assembly fine longitudinal adjustment assembly handle 93 of the magnet assembly fine longitudinal adjustment assembly 89, the magnet assembly fine longitudinal adjustment assembly 89 finely adjusts the longitudinal position of the second slidably mounted magnet assembly 16 relative to the thin rectangular base portion 12 by pushing on the second 90° arc-shaped rectangular cross sectioned magnetic deflection flight tube 126 and thereby longitudinally displacing the second slidably mounted magnet assembly 16.

Regardless of whether the first slidably mounted magnet assembly 14 and the second slidably mounted magnet assembly 16 are positioned in proximity to, or external to, the removably mounted shaped magnetic deflection flight tube assembly 18, the first chamber distal port end flange 102 of the first chamber open distal port end 100 of the first chamber 98 and the first removably mounted chamber thin section 108 of the first chamber 98 removably rests in one of the pair of plate longitudinally positioned semi-circular recesses 54 of the plate frontal area 46 of the thin rectangular-shaped plate 44, and the second chamber distal port end flange 144 of the second chamber open distal port end 142 of the second chamber 140 and the second removably mounted chamber vacuum sealed section 152 of the second chamber 140 removably rests in another one of the pair of plate longitudinally positioned semi-circular recesses 54 of the plate frontal area 46 of the thin rectangular-shaped plate 44 (see FIG. 6).

The operation of the preferred embodiment of the small magnetic sector mass spectrometer 10 can best be seen in FIGS. 8 through 11, and as such, will be discussed with reference thereto.

As shown in FIG. 8, the magnetic deflection flight tube assembly interior vacuum chamber 160 of the removably mounted shaped magnetic deflection flight tube assembly 18 is vacuumized, via the material to be analyzed input port and vacuum port assembly 20.

A material to be analyzed 162 is entered into the magnetic deflection flight tube assembly interior vacuum chamber 160 of the removably mounted shaped magnetic deflection flight tube assembly 18, via the material to be analyzed input port and vacuum port assembly 20.

The material to be analyzed 162 is ionized by the ion source 114 and forms an ion trajectory 164, with a half angle of divergence $\alpha_{114}$ that is zero and therefore negligible, which is contained in the magnetic deflection flight tube assembly interior vacuum chamber 160 of the removably mounted shaped magnetic deflection flight tube assembly 18. The ion source 114 can be any ion source defined by the half angle of divergence $\alpha_{114}$ and the energy dispersion $\Delta V_{114}$.

The width of the ion trajectory 164 leaving the ion source 114 is limited by an ion source exit slit 166 that has an ion source exit slit width $S_{166}$ in mm and from which the ion trajectory 164 is emitted with a kinetic energy equal to the ion source accelerating potential $V_{114}$.

The ion trajectory 164 leaving the ion source exit slit 166 passes through a first ion trajectory defining slit 168 that has a first ion trajectory defining slit width $S_{168}$ which defines the half angle of divergence for focusing $\alpha_{168}$.

The ion source exit slit 166 and the first ion trajectory defining slit 168 are contained in the first chamber 98.

The ion trajectory 164 leaving the first ion trajectory defining slit 168 is collimated and enters a first magnet assembly 90° magnetic field 170 that is created by the first yoke upper horizontal neodymium iron boron magnetic 90° sector with linear or circular pole tips 80 and the first yoke lower horizontal neodymium iron boron magnetic 90° sector with linear or circular pole tips 81 of the first slidably mounted magnet assembly 14 wherein the first slidably mounted magnet assembly 14 and the second slidably mounted magnet assembly 16 are in the high intensity position.

The ion trajectory 164 entering the first magnet assembly 90° magnetic field 170 is bent 90° with a first magnet assembly 90° magnetic field radius of curvature $R_{170}$ and is momentum selected.

For example, if the ion source exit slit width $S_{166}$ of the ion source exit slit 166 is 0.3 mm, and if the first ion trajectory defining slit width $S_{168}$, of the first ion trajectory defining slit 168 is 0.3 mm, and if the distance between the ion source exit slit 166 and the first ion trajectory defining slit 168 is 3 cm, then the half angle of divergence for focusing $\alpha_{168}$ would be 0.005 radians.

The ion trajectory 164 leaving the first slidably mounted magnet assembly 14 at or about a first magnetic assembly 90° pole piece exit face 172—the exact position depending upon the fringing field of the first slidably mounted magnet assembly 14—focused at an ion trajectory first focal point 174.

After the ion trajectory first focal point 174 the ion trajectory 164 begins to diverge with an ion trajectory first focal point half angle of divergence $\alpha_{174}$ equal to:

$$\alpha_{174}=S_{166}/2R_{170}$$

After the ion trajectory 164 begins to diverge, the ion trajectory 164 is further defined by a second ion trajectory defining slit 176 with a second ion trajectory defining slit width $S_{176}$ of 0.125 mm which is disposed midway between the first slidably mounted magnet assembly 14 and the second slidably mounted magnet assembly 16 at the point where the second magnetic deflection flight tube distal end circular flange 134 of the second magnetic deflection flight tube open distal end 130 of the second 90° arc-shaped rectangular cross sectioned magnetic deflection flight tube 126 meets the first magnetic deflection flight tube distal end circular flange 122 of the first magnetic deflection flight tube open distal end 120 of the first 90° arc-shaped rectangular cross sectioned magnetic deflection flight tube 116.

The ion trajectory 164 leaving the second ion trajectory defining slit 176 is collimated and enters a second magnet assembly 90° magnetic field 178 that is created by the second yoke upper horizontal neodymium iron boron magnetic 90° sector with linear or circular pole tips 94 and the second yoke lower horizontal neodymium iron boron magnetic 90° sector with linear or circular pole tips 96 of the second slidably mounted magnet assembly 16.

The ion trajectory 164 entering the second magnet assembly 90° magnetic field 178 is bent 90° with a second magnet assembly 90° magnetic field radius of curvature $R_{178}$ and is again momentum selected.

The ion trajectory 164 leaving the second slidably mounted magnet assembly 16 at a second magnetic assembly 90° pole piece exit face 179 is further defined by passing through a third ion trajectory collection defining slit 180 with a third ion trajectory collection defining slit width $S_{180}$ of 0.125 mm. The third ion trajectory collection defining slit 180 is contained in the second chamber 140.

The distance between the first slidably mounted magnet assembly 14 and the second slidably mounted magnet assembly 16 is equal to the first 90° arc-shaped magnetic deflection flight tube central radius of curvature 119 of the first 90° arc-shaped rectangular cross sectioned magnetic deflection flight tube 116, and the distance between the second magnetic assembly 90° pole piece exit face 179 of the second slidably mounted magnet assembly 16 and the third ion trajectory collection defining slit 180 is also equal to the first 90° arc-shaped magnetic deflection flight tube central radius of curvature 119 of the of the first 90° arc-shaped rectangular cross sectioned magnetic deflection flight tube 116.

Since the half angle of divergence $\alpha_{114}$ is zero and therefore negligible, the third ion trajectory collection defining slit ion trajectory width $X_{180}$ of the ion trajectory 164 leaving the third ion trajectory collection defining slit 180 can be determined by a properly programmed calculator or a properly programmed computer and is equal to:

$$X_{180}=(\Delta V_{114}/V_{114})R_{170}$$

The ion trajectory 164 leaving the third ion trajectory collection defining slit 180 is received by the ion detector 158 that is in electrical communication with an electrometer 182.

Figure 9:
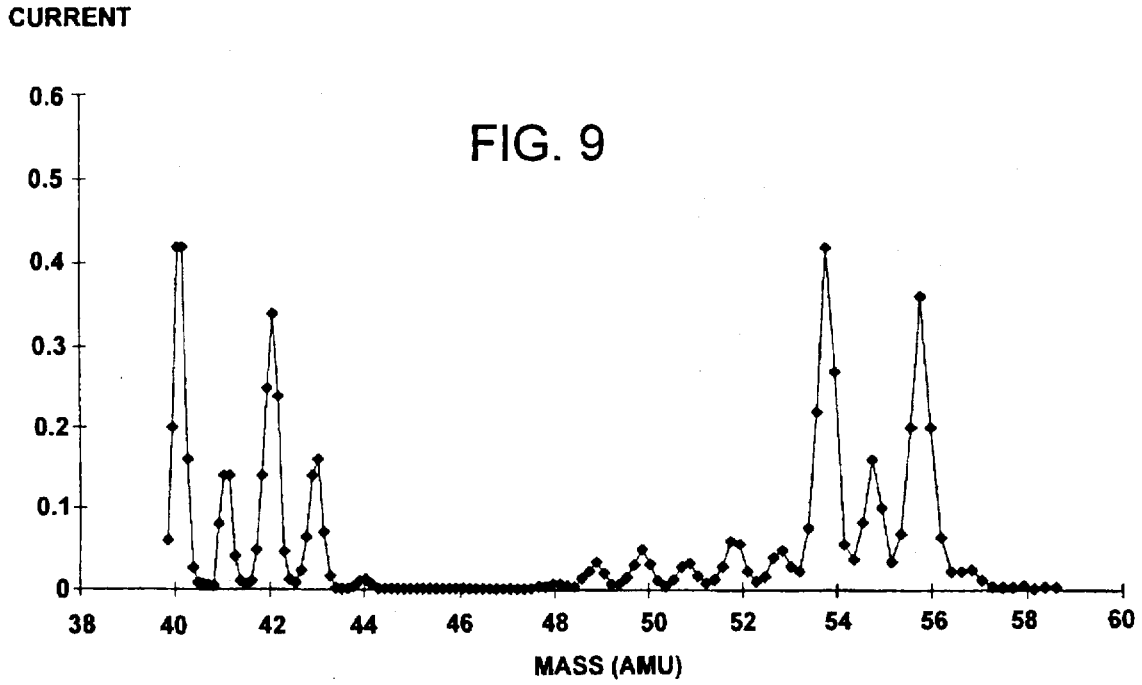
FIG. 9 is a graphical representation of the mass spectrum for the high resolution embodiment of the present invention utilizing the configuration of FIG. 8 with the tandem magnet assemblies in the high intensity position.

The graphical representation of the mass spectrum wherein the first slidably mounted magnet assembly 14 and the second slidably mounted magnet assembly 16 are operating in the high intensity position is illustrated in FIG. 9 wherein the spectrometry is performed in a high mass region.

Figure 10:
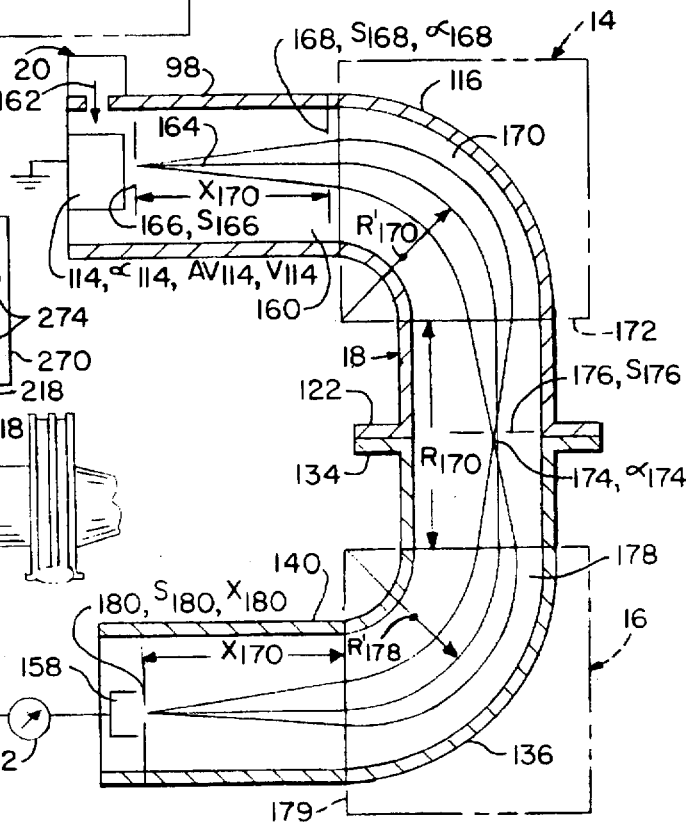
FIG. 10 is an enlarged cross sectional view taken on line 10—10 in FIG. 1 illustrating the ion trajectory leaving the ion source of the high resolution embodiment of the present invention with angular divergence.

As shown in FIG. 10, the structure is similar to that shown in FIG. 8 except for the smaller size of the ion source exit slit width $S_{166}$ of the ion source exit slit 166, the half angle of divergence $\alpha_{114}$ not being negligible, and the ion trajectory first focal point 174 being positioned at the second ion trajectory defining slit 176.

Since the half angle of divergence $\alpha_{114}$ is not negligible and must be considered, the third ion trajectory collection defining slit ion trajectory width $X_{180}$ of the ion trajectory 164 leaving the third ion trajectory collection defining slit 180 can be determined by a properly programmed calculator or a properly programmed computer and is equal to:

$$X_{180}=2\alpha_{114}R+(\Delta V_{114}/V_{114})R_{170}$$

It can be further shown that when the third ion trajectory collection defining slit width $S_{180}$ of the third ion trajectory collection defining slit 180 is equal to the second ion trajectory defining slit $S_{176}$ of the second ion trajectory defining slit 176, the third ion trajectory collection defining slit ion trajectory width $X_{180}$ of the ion trajectory 164 leaving the third ion trajectory collection defining slit 180 can be determined by a properly programmed calculator or a properly programmed computer and is equal to:

$$X_{180}=S_{180}+(\Delta V_{114}/V_{114})R_{170}$$

By the use of both the first slidably mounted magnet assembly 14 and the second slidably mounted magnet assembly 16 being positioned in tandem, double momentum selection is provided that allows the reduction of the effect of scattered ions, so that adjacent masses can be more readily identified in a quantifiable way termed "abundance sensitivity" with a measured resolution of 70 at 0.1 peak height, and 130 at 0.5 peak height, when the ion source exit slit 166, the second ion trajectory defining slit 176, and the third ion trajectory collection defining slit 180 are 0.008", 0.005", and 0.005", respectively.

When the first slidably mounted magnet assembly 14 and the second slidably mounted magnet assembly 16 are manually moved 45° diagonally outwardly to the low intensity position where both the first slidably mounted magnet assembly 14 and the second slidably mounted magnet assembly 16 are positioned outside the magnetic deflection flight tube assembly interior vacuum chamber 160 of the removably mounted shaped magnetic deflection flight tube assembly 18, a line drawn from the center of the ion source exit slit 166 to the center of the ion trajectory first focal point 174 (midway between the first slidably mounted magnet assembly 14 and the second slidably mounted magnet assembly 16) intersects the origin of a low intensity first magnet assembly 90° magnetic field radius of curvature $R'_{170}$ of the ion trajectory 164 passing through the first magnet assembly 90° magnetic field 170.

Similarly, a line drawn from the center of the ion trajectory first focal point 174 (midway between the first slidably mounted magnet assembly 14 and the second slidably mounted magnet assembly 16) to the center of the third ion trajectory collection defining slit 180 intersects the origin of a low intensity second magnet assembly 90° magnetic field radius of curvature $R'_{178}$ of the ion trajectory 164 passing through the second magnet assembly 90° magnetic field 178.

And, the distance from the ion source exit slit 166 to the first slidably mounted magnet assembly 14 is equal to the distance from the first slidably mounted magnet assembly 14 to the second slidably mounted magnet assembly 16 which is equal to the distance from the second slidably mounted magnet assembly 16 to the third ion trajectory collection defining slit 180 and for the sake of simplicity is defined as a low intensity distance $X_{170}$.

Experiments performed with the aforementioned geometry of the first slidably mounted magnet assembly 14 and the second slidably mounted magnet assembly being in the low intensity position indicate an average resolution loss of 20% but allows spectrometry to be performed in a 40% lower mass region without any interruption in vacuum.

Figure 11:
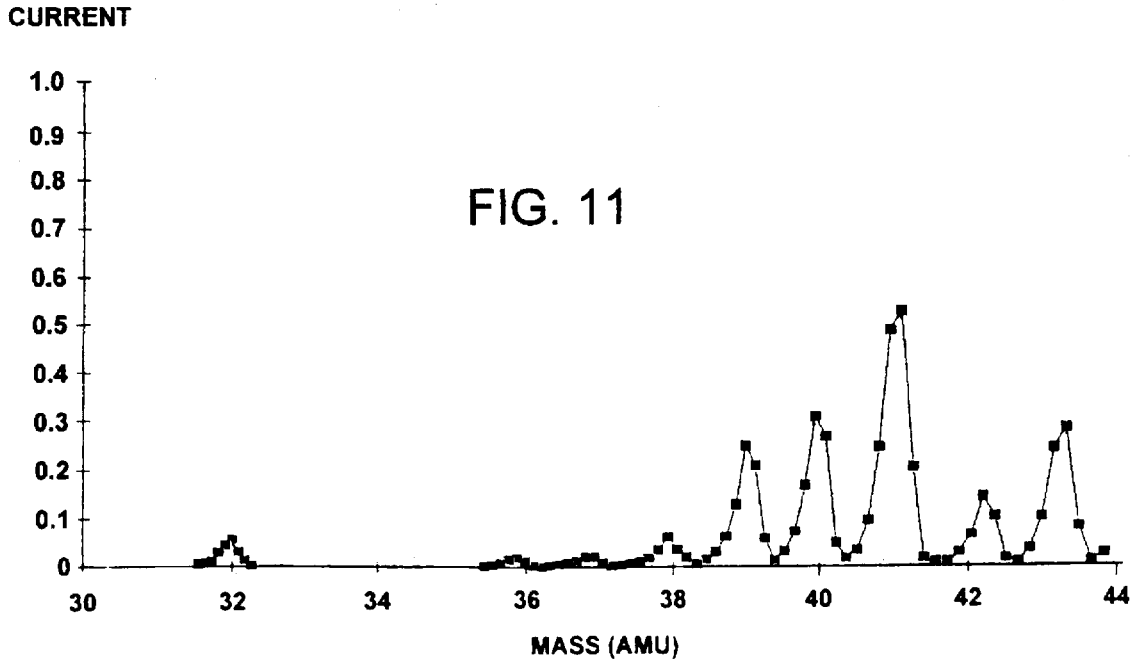
FIG. 11 is a graphical representation of the mass spectrum for the high resolution embodiment of the present invention utilizing the low intensity position of the tandem magnet assemblies.

The graphical representation of the mass spectrum wherein the first slidably mounted magnet assembly 14 and the second slidably mounted magnet assembly 16 are operating in the low intensity position is illustrated in FIG. 11 wherein the spectrometry is performed in a low mass region.

Figure 13:
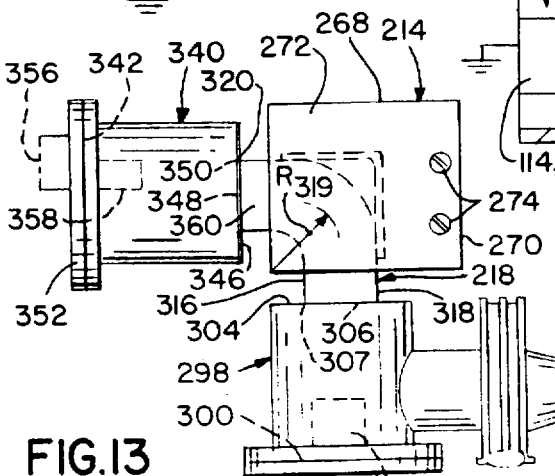
FIG. 13 is a diagrammatic top plan view, with parts broken away, taken in the direction of arrow 13 in FIG. 12
Figure 12:
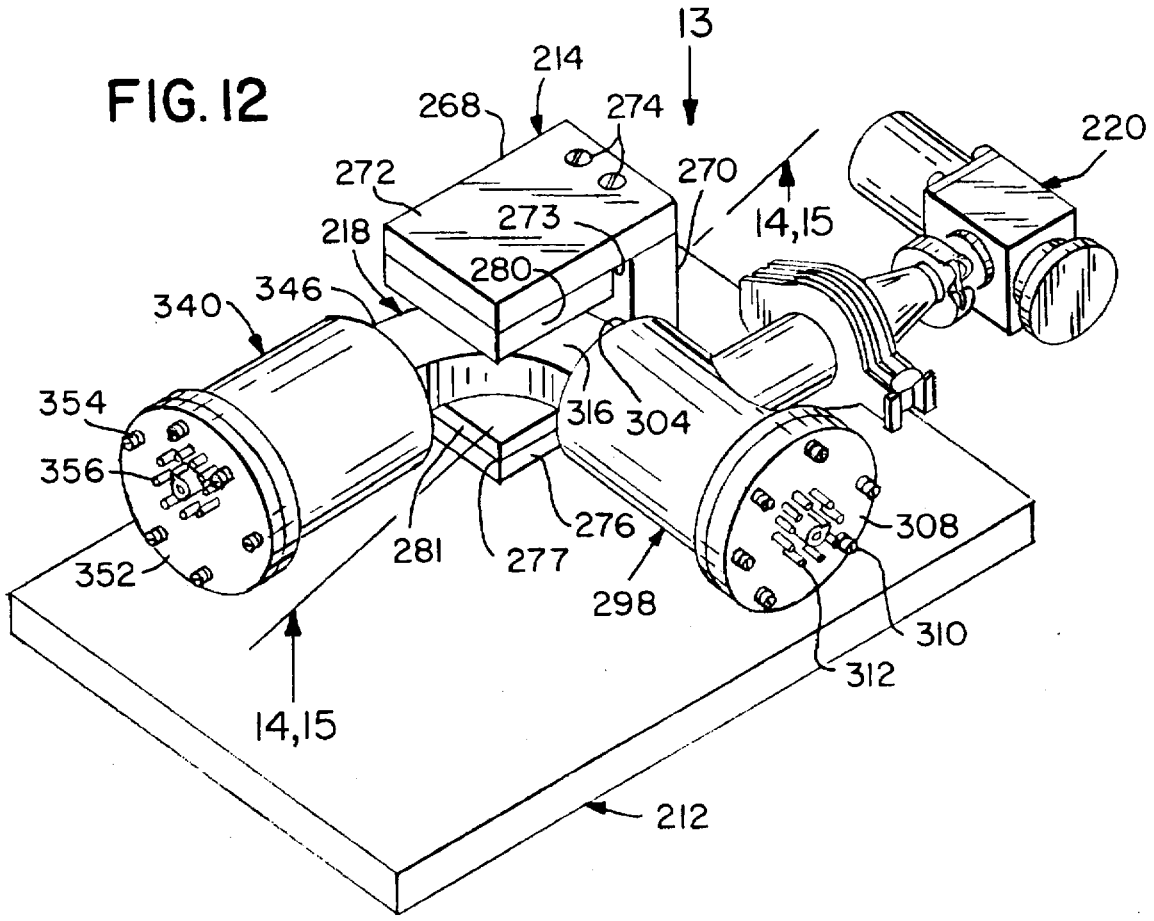
FIG. 12 is a diagrammatic perspective view of an alternate embodiment of the present invention utilizing a single magnet.

The configuration of the alternate embodiment of the small magnetic sector mass spectrometer 210 can best be seen in FIGS. 12 and 13, and as such, will be discussed with reference thereto.

The small magnetic sector mass spectrometer 210 includes a thin rectangular-shaped base portion 212, a fixedly mounted magnet assembly 214 that is fixedly mounted to the thin rectangular-shaped base portion 212 and has a magnetic field of 6000 Gauss, a removably mounted magnetic deflection flight tube assembly 218 that is removably mounted to the thin rectangular-shaped base portion 212, and a material to be analyzed input port and vacuum port assembly 220.

The fixedly mounted magnet assembly 214 includes a substantially C-shaped inwardly opening soft iron highly permeable yoke 268 that has a yoke vertical part 270, a yoke upper horizontal part 272 with a yoke upper horizontal part inner surface 273 that is affixed to the yoke vertical part 270 of the substantially C-shaped inwardly opening soft iron highly permeable yoke 268 by a plurality of yoke upper horizontal part affixing screws 274, and a yoke lower horizontal part 276 with a yoke lower horizontal part inner surface 277 that is affixed to the yoke vertical part 270 of the substantially C-shaped inwardly opening soft iron highly permeable yoke 268 by a plurality of yoke lower horizontal part affixing screws (not shown but identical to the plurality of yoke upper horizontal part affixing screws 274).

The yoke lower horizontal part 276 of the substantially C-shaped inwardly opening soft iron highly permeable yoke 268 is displaced a distance below, and parallel to, the yoke upper horizontal part 272 of the substantially C-shaped inwardly opening soft iron highly permeable yoke 268.

The fixedly mounted magnet assembly 214 further includes a yoke upper horizontal neodymium iron boron magnetic 90° sector with linear or circular pole tips 280 that is affixed preferably by epoxy or screws to the yoke upper horizontal part inner surface 273 of the yoke upper horizontal part 272 of the substantially C-shaped inwardly opening soft iron highly permeable yoke 268 and whose entry and exit faces are 90° relative to each other.

The fixedly mounted magnet assembly 14 further includes a yoke lower horizontal neodymium iron boron magnetic 90° sector with linear or circular pole tips 281 that is affixed preferably by epoxy or screws to the yoke lower horizontal part inner surface 277 of the yoke lower horizontal part 276 of the substantially C-shaped inwardly opening soft iron highly permeable yoke 268 and whose entry and exit faces are 90° relative to each other.

The yoke lower horizontal neodymium iron boron magnetic 90° sector with linear or circular pole tips 281 is positioned a distance below, and parallel to, the yoke upper horizontal neodymium iron boron magnetic 90° sector with linear or circular pole tips 280.

The removably mounted magnetic deflection flight tube assembly 218 includes a first chamber 298 that has a first chamber open distal port end 300 with a first chamber distal port end flange 302 that extends outwardly from, and surrounds, the first chamber open distal port end 300 of the first chamber 298, and a first chamber closed proximal end 304 with a first chamber closed proximal end centrally disposed rectangular-shaped throughbore 306 that has a first chamber closed proximal end rectangular-shaped throughbore perimeter 307.

A first removably mounted chamber thin section 308 is removably mounted to the first chamber 298 and selectively opens and closes the first chamber open distal port end 300 of the first chamber 298, so that the components contained in the first chamber 298 can be readily accessed.

When the first removably mounted chamber thin section 308 of the first chamber 298 closes the first chamber open distal port end 300 of the first chamber 298, the first removably mounted chamber thin section 308 of the first chamber 298 mates with the first chamber distal port end flange 302 of the first chamber open distal port end 300 of the first chamber 298 and is removably secured thereto by a plurality of first chamber vacuum sealed section affixing screws 310.

The first removably mounted chamber thin section 308 of the first chamber 298 has a plurality of outwardly extending first vacuum sealed section isolated, and vacuum sealed electrodes 312 extending outwardly therefrom.

Contained in the first chamber 298 is an ion source 314 that may be a Nier-type electron bombardment source using an accelerating voltage of 70 to 1000 volts. The ion source 314 is positive or negative ions and is in electrical communication with the plurality of outwardly extending first vacuum sealed section isolated, and vacuum sealed electrodes 312 of the first removably mounted chamber thin section 308 of the first chamber 298 which in turn are in electrical communication with different potentials to power the various components of the ion source 314.

The removably mounted magnetic deflection flight tube assembly 218 further includes a 90° arc-shaped rectangular cross sectioned magnetic deflection flight tube 316 with a magnetic deflection flight tube open proximal end 318 that extends from the first chamber closed proximal end rectangular-shaped throughbore perimeter 307 of the first chamber closed proximal end centrally disposed rectangular-shaped throughbore 306 of the first chamber 298 with the interior of the first chamber 298 being in communication with the interior of the 90° arc-shaped rectangular cross sectioned magnetic deflection flight tube 316, a first magnetic deflection flight tube open distal end 320 that is oriented 90° to the magnetic deflection flight tube open proximal end 318 of the 90° arc-shaped rectangular cross sectioned magnetic deflection flight tube 316, and a 90° arc-shaped magnetic deflection flight tube central radius of curvature 319 of 3.2 cm.

The 90° arc-shaped rectangular cross sectioned magnetic deflection flight tube 326 of the removably mounted shaped magnetic deflection flight tube assembly 218 is not a highly electrically conductive metal preferably stainless steel and may moreover be constructed in an inexpensive way by using tubing compressed in the appropriate area to fit through the fixedly mounted magnet assembly 214.

The magnetic deflection flight tube open proximal end 318 of the 90° arc-shaped rectangular cross sectioned magnetic deflection flight tube 316 and the magnetic deflection flight tube open distal end 320 of the 90° arc-shaped rectangular cross sectioned magnetic deflection flight tube 316 lie in perpendicular planes, so that an ionized material entering the magnetic deflection flight tube open proximal end 318 of the 90° arc-shaped rectangular cross sectioned magnetic deflection flight tube 316 will exit the magnetic deflection flight tube open distal end 320 of the 90° arc-shaped rectangular cross sectioned magnetic deflection flight tube 316 in a direction 90° from its entry.

The removably mounted magnetic deflection flight tube assembly 218 further includes a second chamber 340 that has a second chamber open distal port end 342 with a second chamber distal port end flange 344 that extends outwardly from, and surrounds, the second chamber open distal port end 342 of the second chamber 340, and a second chamber closed proximal end 346 with a second chamber closed proximal end centrally disposed rectangular-shaped throughbore 348 that has a second chamber closed proximal end rectangular-shaped throughbore perimeter 350.

The second chamber 340 and the first chamber 298 lie in perpendicular plane and are displaced a distance from each other in perpendicular relationship.

The magnetic deflection flight tube open distal end 320 of the 90° arc-shaped rectangular cross sectioned magnetic deflection flight tube 316 extends from the second chamber closed proximal end rectangular-shaped throughbore perimeter 350 of the second chamber closed proximal end centrally disposed rectangular-shaped throughbore 348 of the second chamber 340 with the interior of the 90° arc-shaped rectangular cross sectioned magnetic deflection flight tube 316 being in communication with the interior of the second chamber 340.

A second removably mounted chamber vacuum sealed section 352 is removably mounted to the second chamber 340 and selectively opens and closes the second chamber open distal port end 342 of the second chamber 340, so that the components contained in the second chamber 340 can be readily accessed. The second removably mounted chamber vacuum sealed section 352 is vacuum sealed to the to the second chamber 340 by the use of, but not limited to, VITON "O" rings or other approaches such as metal seal technology.

When the second removably mounted chamber vacuum sealed section 352 of the second chamber 340 closes the second chamber open distal port end 344 of the second chamber 340, the second removably mounted chamber vacuum sealed section 352 of the second chamber 340 mates with the second chamber distal port end flange 344 of the second chamber open distal port end 342 of the second chamber 340 and is removably secured thereto by a plurality of second chamber vacuum sealed section affixing screws 354.

The second removably mounted chamber vacuum sealed section 352 of the second chamber 340 has a plurality of outwardly extending second vacuum sealed section isolated, and vacuum sealed electrodes 356 extending outwardly therefrom.

Contained in the second chamber 340 is an ion detector 358 that may be a Faraday cup or an electron multiplier or other ion detection device. The ion detector 358 is in electrical communication with the plurality of outwardly extending second vacuum sealed section isolated, and vacuum sealed electrodes 356 of the second removably mounted chamber vacuum sealed section 352 of the second chamber 340 which in turn are in electrical communication with an electrometer or other output device (not shown).

Since the interior of the first chamber 298 is in communication with the interior of the 90° arc-shaped rectangular cross sectioned magnetic deflection flight tube 316, and since the interior of the 90° arc-shaped rectangular cross sectioned magnetic deflection flight tube 316 is in communication with the interior of the second chamber 340, the interior of the removably mounted magnetic deflection flight tube assembly 318 is continuous and contains a magnetic deflection flight tube assembly interior vacuum chamber 360 which operates at a pressure of less than 3×10E-5 Torr.

The operation of the alternate embodiment of the small magnetic sector mass spectrometer 210 can best be seen in FIGS. 14 and 15, and as such, will be discussed with reference thereto.

Figure 14:
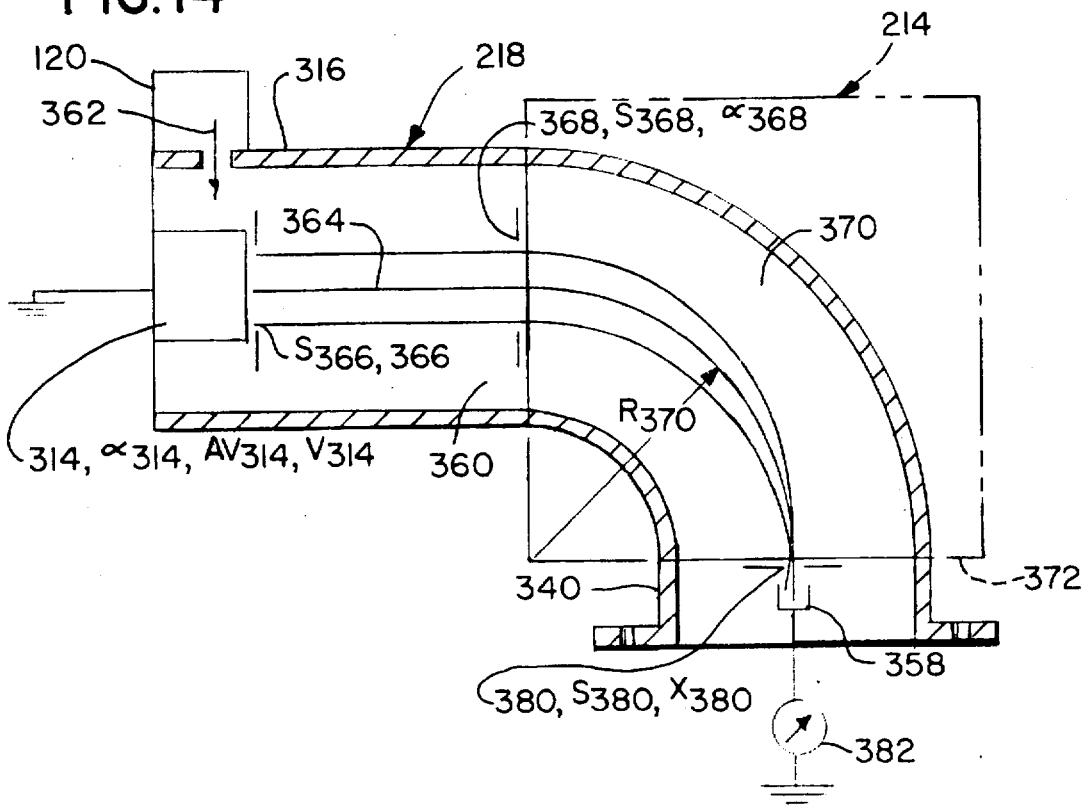
FIG. 14 is an enlarged cross sectional view taken on line 14—14 in FIG. 12 illustrating the ion trajectory leaving the ion source of the alternate embodiment of the present invention with negligible angular divergence.

As shown in FIG. 14, the magnetic deflection flight tube assembly interior vacuum chamber 360 of the removably mounted magnetic deflection flight tube assembly 218 is vacuumized, via the material to be analyzed input port and vacuum port assembly 120.

A material to be analyzed 362 is entered into the magnetic deflection flight tube assembly interior vacuum chamber 360 of the removably mounted magnetic deflection flight tube assembly 218, via the material to be analyzed input port and vacuum port assembly 120.

The material to be analyzed 362 is ionized by the ion source 314 and forms an ion trajectory 364, with a half angle of divergence $\alpha 3_{66}$ that is zero and therefore negligible, which is contained in the magnetic deflection flight tube assembly interior vacuum chamber 360 of the removably mounted magnetic deflection flight tube assembly 218. The ion source 314 can be any ion source defined by the half angle of divergence $\alpha_{314}$ and the energy dispersion $\Delta V_{314}$.

The width of the ion trajectory 364 leaving the ion source 314 is limited by an ion source exit slit 366 that has an ion source exit slit width S366 in mm and from which the ion trajectory 364 is emitted with a kinetic energy equal to the ion source accelerating potential $V_{366}$.

The ion trajectory 364 leaving the ion source exit slit 366 passes through an ion trajectory defining slit 368 that has an ion trajectory defining slit width $S_{368}$ which defines the half angle of divergence for focusing $\alpha_{368}$.

The ion source exit slit 366 and the ion trajectory defining slit 368 are contained in the first chamber 298.

The ion trajectory 364 leaving the first ion trajectory defining slit 368 is collimated and enters a magnet assembly 90° magnetic field 370 that is created by the yoke upper horizontal neodymium iron boron magnetic 90° sector with linear or circular pole tips 180 and the yoke lower horizontal neodymium iron boron magnetic 90° sector with linear or circular pole tips 181 of the fixedly mounted magnet assembly 214.

The ion trajectory 364 entering the magnet assembly 90° magnetic field 370 is bent 90° with a magnet assembly 90° magnetic field radius of curvature $R_{370}$ and is momentum selected.

For example, if the ion source exit slit width $S_{366}$ of the ion source exit slit 366 is 0.3 mm, and if the ion trajectory defining slit width $S_{368}$ of the ion trajectory defining slit 368 is 0.3 mm, and if the distance between the ion source exit slit 366 and the ion trajectory defining slit 368 is 3 cm, then the half angle of divergence for focusing $\alpha_{368}$ would be 0.005 radians.

The ion trajectory 364 leaving the fixedly mounted magnet assembly 314 at or about the magnetic assembly 90° pole piece exit face 372—the exact position depending upon the fringing field of the fixedly mounted magnet assembly 314—is further defined by passing through a third ion trajectory collection defining slit 380 with a third ion trajectory collection defining slit width $S_{380}$ of 0.125 mm. The third ion trajectory collection defining slit 380 is contained in the second chamber 340.

Since the half angle of divergence $\alpha_{314}$ is zero and therefore negligible, the third ion trajectory collection defining slit ion trajectory width $X_{380}$ of the ion trajectory 364 leaving the third ion trajectory collection defining slit 380 which is independent of the distance between the ion source exit slit 366 and the ion trajectory defining slit 368, can be determined by a properly programmed calculator or a properly programmed computer and is equal to:

$$X_{380}=R_{370}(1-\cos(S_{366}/R_{370}))+(\Delta V_{314}/V_{314})R_{370}$$

The ion trajectory 364 leaving the third ion trajectory collection defining slit 380 is received by the ion detector 358 that is in electrical communication with an electrometer 382.

Figure 15:
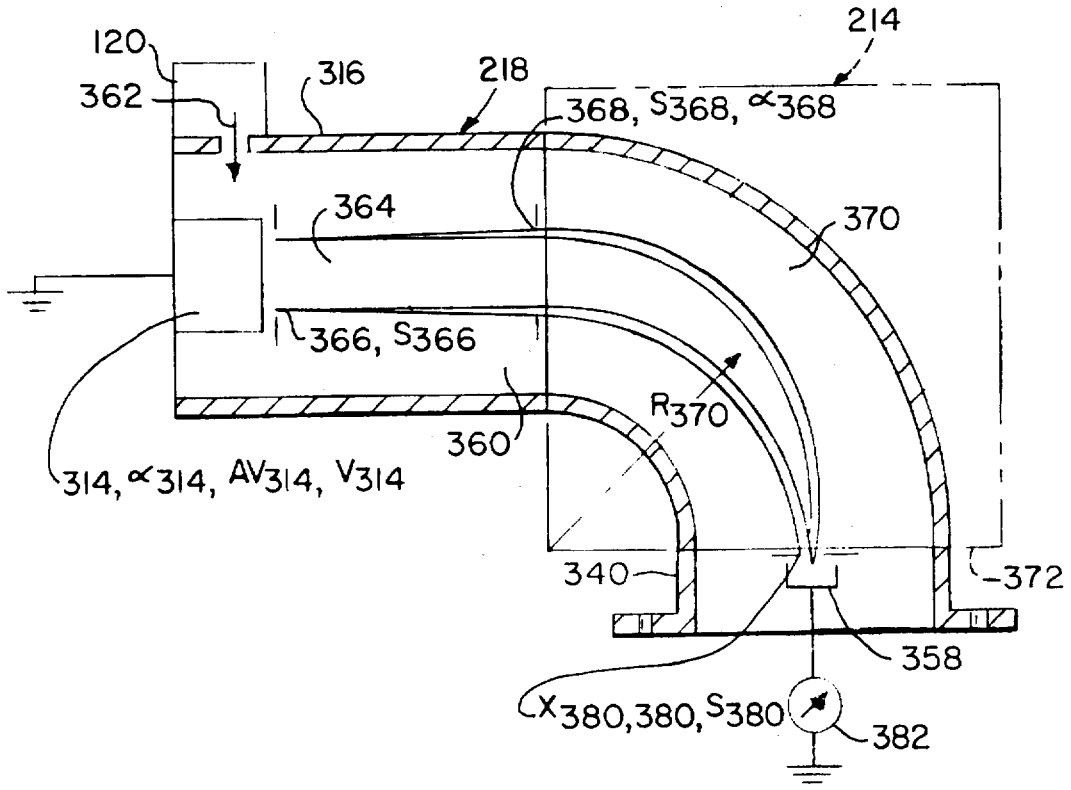
FIG. 15 is an enlarged cross sectional view taken on line 15—15 in FIG. 12 illustrating the ion trajectory leaving the ion source of the alternate embodiment of the present invention with angular divergence.

As shown in FIG. 15, the structure is identical to that shown in FIG. 14 but the half angle of divergence $\alpha_{366}$ is not negligible.

Since the half angle of divergence $\alpha_{366}$ is not negligible and must be considered, the third ion trajectory collection defining slit ion trajectory width $X_{370}$ of the ion trajectory 364 leaving the third ion trajectory collection defining slit 380 can be determined by a properly programmed calculator or a properly programmed computer and is equal to:

$$X_{380}=R_{370}(1-\cos(S_{366}/R_{370})+2\alpha_{314}R_{370}+(\Delta V_{314}/V_{314})R_{370}$$

For example, if the ion source exit slit width $S_{366}$ of the ion source exit slit 366 is 2 mm, and if the ion trajectory defining slit width $S_{368}$ of the ion trajectory defining slit 368 is 2 mm, and if the magnet assembly 90° magnetic field radius of curvature $R_{370}$ of the magnet assembly 90° magnetic field 370 is 2 cm, and if the half angle of divergence $\alpha_{366}$ is equal to 0.01 radians, and if the ion source energy dispersion $\Delta V_{314}$ is negligible, then the third ion trajectory collection defining slit ion trajectory width $X_{380}$ of the ion trajectory 364 is equal to 0.4 mm.

It is to be noted that the half angle of divergence $\alpha_{366}$ can be replaced by the half angle of divergence for focusing $\alpha_{168}$ if the ion source exit slit 366 and the ion trajectory defining slit 368 define the half angle of divergence.

It will be understood that each of the elements described above, or two or more together, may also find a useful application in other types of constructions differing from the types described above.

While the invention has been illustrated and described as embodied in a small magnetic sector mass spectrometer using high energy product density permanent magnets, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A portable magnetic sector mass spectrometer, comprising:

a) a base;

b) first magnetic field generating apparatus using greater than 10E7 GOe permanent magnetic material and being mounted to said base for generating a 90° magnetic field with a radius of curvature and having an entrance and an exit;

c) a smoothly bent magnetic deflection flight tube assembly passing through said first 90° magnetic field and containing a vacuum chamber of less than 3×10E-5 Torr;

d) introducing means disposed in said vacuum chamber of said smoothly bent magnetic deflection flight tube assembly for introducing a material to be analyzed;

e) ionizing means disposed in said vacuum chamber of said smoothly bent magnetic deflection flight tube assembly for ionizing and accelerating by an electrical voltage the material to be analyzed; the ionized material to be analyzed having an ion trajectory contained in said vacuum chamber of said smoothly bent magnetic deflection flight tube assembly; the ion trajectory of the ionized material to be analyzed having a parallel component being focused at a point where the ion trajectory of the ionized material to be analyzed generally exits said first 90° magnetic field generating means;

f) collecting and measuring means disposed in said vacuum chamber of said smoothly bent magnetic deflection flight tube assembly for collecting and measuring the ionized material to be analyzed, wherein said first magnetic field generating means is mounted to said base in a way selected from the group consisting of fixedly and slidably in both lateral and longitudinal directions, so that when said first magnetic field generating means is slidably mounted to said base, said first magnetic field generating means has a high intensity position for source exit focus where said first magnetic field generating means is in proximity to said vacuum chamber of said smoothly bent magnetic deflection flight tube assembly and allowing for a higher mass spectra to be scanned, and a low intensity position using angular focus geometry where said first magnetic field generating means is external to said vacuum chamber of said smoothly bent magnetic deflection flight tube assembly and allowing for a lower mass spectra to be scanned; said smoothly bent magnetic deflection flight tube assembly includes a first chamber that has an open distal pert end with a flange that extends outwardly from, and surrounds, said open distal port end of said first chamber of said smoothly bent magnetic deflection flight tube assembly, an interior space, and a substantially closed proximal end with a centrally disposed throughbore that has a throughbore perimeter; said ionizing means includes an ion source that is contained in said first chamber of said smoothly bent magnetic deflection flight tube assembly; said smoothly bent magnetic deflection flight tube assembly further includes a smoothly bent magnetic deflection flight tube with an interior space, an open inlet end that extends outwardly from said throughbore perimeter of said centrally disposed throughbore of said substantially closed proximal end of said first chamber of said smoothly bent magnetic deflection flight tube assembly, with said interior space of said first chamber of said smoothly bent magnetic deflection flight tube assembly being in communication with said interior space of said smoothly bent magnetic deflection flight tube of said smoothly bent magnetic deflection flight tube assembly, an open outlet end, and a central radius of curvature; said smoothly bent magnetic deflection flight tube assembly further includes a second chamber that has an interior space, an open distal port end with a circular flange that extends outwardly from, and surrounds, said open distal port end of said second chamber, and a substantially closed proximal end with a centrally disposed throughbore that has a throughbore perimeter from which said outlet end of said smoothly bent magnetic deflection flight tube of said smoothly bent magnetic deflection flight tube assembly extends, with said interior space of said second chamber of said smoothly bent magnetic deflection flight tube assembly being in communication with said interior space of said smoothly bent magnetic deflection flight tube of said smoothly bent magnetic deflection flight tube assembly; said first chamber of said smoothly bent magnetic deflection flight tube assembly further contains an ion source exit slit for defining the ion trajectory of the ionized material to be analyzed leaving said ion source of said first chamber of said smoothly bent magnetic deflection flight tube assembly, and a first ion trajectory defining slit for further defining the ion trajectory of the ionized material to be analyzed leaving said ion source exit slit of said first chamber of said smoothly bent magnetic deflection flight tube assembly; said first ion trajectory defining slit of said first chamber of said smoothly bent magnetic deflection flight tube assembly is disposed between said ion source exit slit of said first chamber of said smoothly bent magnetic deflection flight tube assembly and said first magnetic field generating means; said smoothly bent magnetic deflection flight tube assembly further contains a second ion trajectory defining slit for further defining the ion trajectory of the ionized material to be analyzed leaving said first magnetic field generating means; said smoothly bent magnetic deflector flight tube is a pair of 90° bends resulting in a consecutive 90° arc-shape with said first chamber of said smoothly bent magnetic deflection flight tube assembly being parallel to said second chamber of said smoothly bent magnetic deflection flight tube assembly, so that the ionized material to be analyzed that enters said open inlet end of said consecutive 90° arc-shaped magnetic deflection flight tube of said smoothly bent magnetic deflection flight tube assembly will exit said open outlet end of said consecutive 90° arc-shaped magnetic deflection flight tube of said smoothly bent magnetic deflection flight tube assembly in a direction 180° from its entry; said consecutive 90° arc-shaped magnetic deflection flight tube of said smoothly bent magnetic deflection flight tube assembly has a first 90° arc-shaped portion with a central radius of curvature and a second 90° arc-shaped portion contingent with said first 90° arc-shaped portion of said consecutive 90° arc-shaped magnetic deflection flight tube of said smoothly bent magnetic deflection flight tube assembly and has a central radius of curvature equal to said central radius of curvature of said first 90° portion of said consecutive 90° arc-shaped magnetic deflection flight tube of said smoothly bent magnetic deflection flight tube assembly; and g) a second magnetic field generating means identical in configuration to said first magnetic field generating means and slidably mounted to said base in beth the lateral and longitudinal directions, and spaced a distance from said first magnetic field generating means in tandem relationships, so that double momentum selection is provided that allows for the reduction of the effect of scattered ions, and adjacent masses can be more readily identified in a quantifiable way, wherein said second ion trajectory defining slit of said smoothly bent magnetic deflection flight tube assembly is contained in said consecutive 90° arc-shaped magnetic deflection flight tube between said first magnetic field generating means and said second magnetic field generating means; said smoothly bent magnetic deflection flight tube assembly further includes a collecting slit contained in said second chamber of said smoothly bent magnetic deflection flight tube assembly; when said first magnetic field generating means and said second magnetic field generating means are in said low intensity positions, the distance between said ion source exit slit of said first chamber of said smoothly bent magnetic deflection flight tube assembly and said entrance of said first magnetic field generating means, the distance between said exit of said first magnetic field generating means and said entrance of said second magnetic field generating means, and the distance between said exit of said second magnetic field generating means add said collecting slit of said second chamber of said smoothly bent magnetic deflection flight tube assembly are each equal to said radius of curvature of said magnetic field of said first magnetic field generating means.

2. The spectrometer as defined in claim 1, wherein said first magnetic field generating means includes a substantially C-shaped soft iron and highly permeable yoke that has an upper horizontal part with an inner surface and a lower horizontal part with an inner surface that is displaced a distance below, and parallel to, said upper horizontal part of said substantially C-shaped soft iron and highly permeable yoke of said first magnetic field generating means.

3. The spectrometer as defined in claim 2, wherein said first magnetic field generating means further includes an upper high energy product density magnetic 90° pole piece; said upper high energy product density magnetic 90° pole piece is a magnetic material having a density product greater than 10E7 GOe and is affixed to said inner surface of said upper horizontal part of said substantially C-shaped soft iron and highly permeable yoke of said first magnetic field generating means.

4. The spectrometer as defined in claim 3, wherein said first magnetic field generating means further includes a lower high energy product density magnetic 90° pole piece; said lower high energy product density magnetic 90° pole piece is a magnetic material having a density product greater than 10E7 GOe and is affixed to said inner surface of said lower horizontal part of said substantially C-shaped soft iron and highly permeable yoke of said first magnetic field generating means and displaced a distance below, and parallel to, said upper high energy product density magnetic 90° pole piece of said first magnetic field generating means.

5. The spectrometer as defined in claim 4, wherein said smoothly bent magnetic deflection flight tube assembly passes freely between said upper high energy product density magnetic 90° pole piece of said first magnetic field generating means and said lower high energy product density magnetic 90° pole piece of said first magnetic field generating means.

6. The spectrometer as defined in claim 1, wherein said smoothly bent magnetic deflection flight tube assembly further includes a removably mounted vacuum sealed section that is removably mounted to said first chamber of said smoothly bent magnetic deflection flight tube assembly and selectively opens and closes said open distal port end of said first chamber of said smoothly bent magnetic deflection flight tube assembly, so that components contained in said first chamber of said smoothly bent magnetic deflection flight tube assembly can be readily accessed.

7. The spectrometer as defined in claim 6, wherein said removably mounted vacuum sealed section of said first chamber of said smoothly bent magnetic deflection flight tube assembly has a plurality of outwardly extending, isolated, and vacuum sealed electrodes that extend outwardly therefrom.

8. The spectrometer as defined in claim 7, wherein said ion source is selected from the group consisting of positive ion, negative ion, and said introducing means.

9. The spectrometer as defined in claim 8, wherein said ion source of said first chamber of said smoothly bent magnetic deflection flight tube assembly is a Nier-type electron bombardment source with an accelerating voltage of 70 to 1000 volts.

10. The spectrometer as defined in claim 8, wherein said ion source of said first chamber of said smoothly bent magnetic deflection flight tube assembly is in electrical communication with said plurality of outwardly extending, isolated, and vacuum sealed electrodes of said removably mounted vacuum sealed section of said first chamber of said smoothly bent magnetic deflection flight tube assembly which in turn are in electrical communication with different potentials to power the different components of said ion source of said first chamber of said smoothly bent magnetic deflection flight tube assembly.

11. The spectrometer as defined in claim 1, wherein said smoothly bent magnetic deflection flight tube assembly further includes a removably mounted vacuum sealed section that is removably mounted to said second chamber of said smoothly bent magnetic deflection flight tube assembly and selectively opens and closes said open distal port end of said second chamber of said smoothly bent magnetic deflection flight tube assembly, so that components contained in said second chamber of said smoothly bent magnetic deflection flight tube assembly can be readily accessed.

12. The spectrometer as defined in claim 11, wherein said removably mounted vacuum sealed section of said second chamber of said smoothly bent magnetic deflection flight tube assembly has a plurality of outwardly extending, isolated, and vacuum sealed electrodes that extend outwardly therefrom.

13. The spectrometer as defined in claim 1, wherein said collecting means is contained in said second chamber of said smoothly bent magnetic deflection flight tube assembly.

14. The spectrometer as defined in claim 13, wherein said collecting means of said second chamber of said smoothly bent magnetic deflection flight tube assembly includes an ion detector for detecting and measuring an ion current from 10E-5 to 10E-19 amperes and is selected from the group consisting of a Faraday cup, and an electron multiplier.

15. The spectrometer as defined in claim 14, wherein said ion detector of said second chamber of said smoothly bent magnetic deflection flight tube assembly is in electrical communication with a plurality of outwardly extending, isolated, and vacuum sealed electrodes of said removably mounted vacuum sealed section of said second chamber of said smoothly bent magnetic deflection flight tube assembly which in turn are in electrical communication with an output device.

16. The spectrometer as defined in claim 15, wherein said output device is an electrometer.

17. The spectrometer as defined in claim 13, wherein said smoothly bent magnetic deflection flight tube is 90° arc-shaped with said first chamber of said smoothly bent magnetic deflection flight tube assembly being perpendicular to said second chamber of said smoothly bent magnetic deflection flight tube assembly, so that said ionized material to be analyzed that enters said open inlet end of said 90° arc-shaped magnetic deflection flight tube of said smoothly bent magnetic deflection flight tube assembly will exit said open outlet end of said 90° arc-shaped magnetic deflection flight tube of said smoothly bent magnetic deflection flight tube assembly in a direction 90° from its entry.

18. The spectrometer as defined in claim 1, wherein said vacuum chamber of said smoothly bent magnetic deflection flight tube assembly is continuous and consists of said interior space of said first chamber of said smoothly bent magnetic deflection flight tube assembly, said interior space of said smoothly bent magnetic deflection flight tube of said smoothly bent magnetic deflection flight tube assembly, and said interior space of said second chamber of said smoothly bent magnetic deflection flight tube assembly.

19. The spectrometer as defined in claim 1, wherein said second ion trajectory defining slit of said smoothly bent magnetic deflection flight tube assembly is a collecting slit disposed in relationship to an exit face of said first magnetic field generating means in a position selected from the group consisting of at said exit face and near said exit face.

20. The spectrometer as defined in claim 19, wherein said collecting slit of said second chamber of said smoothly bent magnetic deflection flight tube assembly is incorporated with said ion detector of said second chamber of said smoothly bent magnetic deflection flight tube assembly.

21. The spectrometer as defined in claim 1, wherein said consecutive 90° arc-shaped magnetic deflection flight tube of said smoothly bent magnetic deflection flight tube assembly passes between said upper high energy product density magnetic 90° pole piece of said first magnetic field generating means and said lower high energy product density magnetic 90° pole piece of said first magnetic field generating means and between said upper high energy product density magnetic 90° pole piece of second magnetic field generating means and said lower high energy product density magnetic 90° pole piece of said second magnetic field generating means.

22. The spectrometer as defined in claim 1, wherein said collecting slit of said second chamber of said smoothly bent magnetic deflection flight tube assembly is incorporated with said ion detector of said second chamber of said smoothly bent magnetic deflection flight tube assembly.

23. The spectrometer as defined in claim 1, wherein when said first magnetic field generating means and said second magnetic field generating means are in said low intensity position, a line connecting said ion source exit slit of said first chamber of said smoothly bent magnetic deflection flight tube assembly to said second ion trajectory defining slit of said consecutive 90° arc-shaped magnetic deflection flight tube of said smoothly bent magnetic deflection flight tube assembly intersects the origin of said radius of curvature of said magnetic field of said first magnetic field generating means, and a line connecting said second ion trajectory defining slit of said consecutive 90° arc-shaped magnetic deflection flight tube of said smoothly bent magnetic deflection flight tube assembly and said collecting slit of said second chamber of said smoothly bent magnetic deflection flight tube assembly intersects the origin of said radius of curvature of said magnetic field of said second magnetic field generating means.

24. A method of using a portable magnetic sector mass spectrometer having a single magnet assembly, comprising the steps of:

a) vacuumizing a 90° arc-shaped magnetic deflection flight tube assembly of said portable magnetic sector mass spectrometer;

b) entering a material to be analyzed into said vacuumized 90° arc-shaped magnetic deflection flight tube assembly;

c) ionizing the material to be analyzed by an ion source of said portable magnetic sector mass spectrometer and forming an ion trajectory having a width contained in said vacuumized 90° arc-shaped magnetic deflection flight tube assembly; said ion source having a half angle of divergence $\alpha$, an energy dispersion $\Delta V$, and an accelerating potential V;

d) defining said width of said ion trajectory leaving said ion source by an ion source exit slit having a width S from which said ion trajectory is emitted with a kinetic energy equal to said accelerating potential V of said ion source;

e) collimating said defined ion trajectory leaving said ion source by an ion trajectory defining slit of said portable magnetic sector mass spectrometer;

f) entering said collimated ion trajectory into a 90° magnetic field having a radius of curvature R which is created by a pair of parallel and spaced apart high energy product density magnetic 90° pole pieces of a magnetic material greater than 10E7 Goe;

g) bending said collimated ion trajectory entering said 90° magnetic field and being momentum selected;

h) defining further a width X of said bent ion trajectory leaving said 90° magnetic field by an ion trajectory collection defining slit of said portable magnetic sector mass spectrometer;

i) receiving said further defined ion trajectory leaving said ion trajectory collection defining slit by an ion detector of said portable magnetic sector mass spectrometer; and j) determining said width X of said further defined ion trajectory leaving said ion trajectory collection defining slit when $\alpha=0$, so that $$X=R(1-\cos(S/R))+(\Delta V/V)R.$$

25. The method as defined in claim 24, further comprising the step of determining said width X of said further defined ion trajectory leaving said ion trajectory collection defining slit when $\alpha=0$, so that $$X=R(1-\cos(S/R))+2\alpha R+(\Delta V/V)R.$$

26. A method of using a portable magnetic sector mass spectrometer having a pair of tandem magnet assemblies, comprising the steps of:

a) vacuumizing a consecutive 90° arc-shaped magnetic deflection flight tube assembly of said portable magnetic sector mass spectrometer;

b) entering a material to be analyzed into said vacuumized consecutive 90° arc-shaped magnetic deflection flight tube assembly;

c) ionizing the material to be analyzed by an ion source of said portable magnetic sector mass spectrometer and forming an ion trajectory having a width contained in said vacuumized consecutive 90° arc-shaped magnetic deflection flight tube assembly; said ion source having a half angle of divergence $\alpha$, an energy dispersion $\Delta V$, and an accelerating potential V;

d) defining said width of said ion trajectory leaving said ion source by an ion source exit slit having a width S from which said ion trajectory is emitted with a kinetic energy equal to said accelerating potential V of said ion source;

e) collimating said defined ion trajectory leaving said ion source by a first ion trajectory defining slit of said portable magnetic sector mass spectrometer;

f) entering said collimated ion trajectory into a first 90° magnetic field having a radius of curvature R which is created by a pair of parallel and spaced apart high energy product density magnetic 90° pole pieces of a magnetic material greater than 10E7 Goe;

g) bending said collimated ion trajectory entering said first 90° magnetic field and being momentum selected;

h) defining further said width of said bent ion trajectory leaving said first 90° magnetic field by an ion trajectory focusing slit that has a width $S_f$;

i) entering said further defined ion trajectory into a second 90° magnetic field that has a radius of curvature R which is created by a pair of parallel and spaced apart high energy product density magnetic 90° pole pieces of a magnetic material greater than 10E7 Goe;

j) bending said further defined ion trajectory entering said second 90° magnetic field and again being momentum selected;

k) defining further a width X of said bent ion trajectory leaving said second 90° magnetic field by an ion trajectory collection defining slit having a width $S_c$;

l) receiving said further defined ion trajectory leaving said ion trajectory collection defining slit by an ion detector of said portable magnetic sector mass spectrometer; and m) determining said width X of said further defined ion trajectory leaving said ion trajectory collection defining slit when $\alpha=0$, so that $$X=(\Delta V/V)R.$$

27. The method as defined in claim 26; further comprising the step of determining said width X of said further defined ion trajectory leaving said ion trajectory collection defining slit when $\alpha=0$, and $S_f=S_c$, so that $$X=S_c+(\Delta V/V)R.$$

28. The method as defined in claim 26, further comprising the step of determining said width X of said further defined ion trajectory leaving said ion trajectory collection defining slit when $\alpha\neq0$, so that $$X=2\alpha R+(\Delta V/V)R.$$

* * * * *